US006644786B1

(12) United States Patent
Lebens

(10) Patent No.: US 6,644,786 B1
(45) Date of Patent: Nov. 11, 2003

(54) METHOD OF MANUFACTURING A THERMALLY ACTUATED LIQUID CONTROL DEVICE

(75) Inventor: John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 106 days.

(21) Appl. No.: 10/191,002

(22) Filed: Jul. 8, 2002

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63, 127; 399/261; 361/700; 310/328–330; 29/890.1; 216/4, 48; 430/311

(56) References Cited

U.S. PATENT DOCUMENTS 6,028,615 A * 2/2000 Pletcher et al. ..... 347/127

* cited by examiner

*Primary Examiner*—Raquel Yvette Gordon
(74) *Attorney, Agent, or Firm*—William R. Zimmerli

(57) ABSTRACT

Methods for manufacturing thermally actuated liquid control devices such as ink jet printheads and fluid microvalves are disclosed. Thermal actuators for a micro-electromechanical devices are manufactured by process steps of forming a bottom layer of a bottom material on a substrate having a flat surface and composed of a substrate material; and removing the bottom material in a bottom layer pattern wherein a moveable area located between opposing free edges remains on the substrate. A deflector layer of a deflector material is formed over the bottom layer and patterned so that the deflector material does not overlap the free edges of the bottom layer material. A top layer of a top material is formed over the deflector layer, the bottom layer, and the substrate and patterned so that the top material overlaps the deflector layer material but does not completely overlap the substrate material in the free edge area. A layer of a sacrificial material is conformed over the top, deflector, bottom layers and substrate in sufficient thickness to result in a planar sacrificial layer surface parallel to the flat surface of the substrate. The sacrificial material is patterned so that sacrificial material remains in movement areas and adjacent free edge areas. A structure layer of a structure material is formed over the sacrificial layer and patterned to have openings which expose the sacrificial material in movement areas. The substrate material beneath the moveable area is removed so that the free edges of the bottom layer are released from the substrate and the exposed sacrificial material is removed from the movement areas and free edge areas thereby creating a movement volume for the thermal actuator. High temperature microelectronic fabrication processes may be used for forming the bottom, deflector and top layer materials. The openings in the structure material may serve as nozzles for a liquid drop emitter or as outlet ports for a microvalve. In some preferred embodiments of the inventions, the deflector layer of the thermal actuator may be formed with an electrically resistive material, especially titanium aluminide, the bottom layer may be formed by oxidation of the substrate, and the sacrificial material may be non-photoimageable polyimide.

42 Claims, 17 Drawing Sheets

METHOD OF MANUFACTURING A THERMALLY ACTUATED LIQUID CONTROL DEVICE

CROSS REFERENCE TO RELATED APPLICATION

Reference is made to U.S. patent application Ser. No. 09/726,945 filed Nov. 30, 2000, for "Thermal Actuator", assigned to the assignee of the present invention.

FIELD OF THE INVENTION

The present invention relates generally to methods of manufacturing micro-electromechanical devices and, more particularly, to methods for manufacturing thermally actuated manufacturing liquid control devices such as the type used in liquid drop emitters, ink jet printheads and microfluidic valves.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to open or close a fluid flow valve. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of inkjet printing, thermal ink jet (or "bubble jet"), uses electrically resistive heaters to generate vapor bubbles which cause drop emission, as is discussed by Hara et al., in U.S. Pat. No. 4,296,421.

Electrically resistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648, and for dispensing microdrops for medical inhalation therapy as disclosed by Psaros et al., in U.S. Patent 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Methods of manufacture are needed which utilize the cost advantages of microelectronic fabrication to form mechanical actuators which can usefully perform in contact with a variety of working fluid chemistries and formulations.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission.

A second configuration of a DOD ink jet device which uses a thermo-mechanical actuator was disclosed by Matoba, et al. in U.S. Pat. No. 5,684,519. The actuator is formed as a thin beam constructed of a single electroresistive material located in an ink chamber opposite an ink ejection nozzle. The beam buckles due to compressive thermo-mechanical forces when current is passed through the beam. The beam is pre-bent into a shape bowing towards the nozzle during fabrication so that the thermo-mechanical buckling always occurs in the direction of the pre-bending.

A microvalve device which uses a thermo-mechanical actuator was disclosed by Wood, et al., in U.S. Pat. No. 5,909,078. The actuator is configured as an arched beam which extends between spaced apart supports on a microelectronic substrate. The arched beam expands when heated either from an external source or internally by passing current through an electrically resistive layer in the beam. A coupler mechanically couples the arched beam to a valve plate to open and close a fluid microvalve.

Thermo-mechanical actuators having either cantilevered members with free ends, or anchored members with at least two free opposing edges to allow movement, are useful in fluid control devices such as liquid drop emitters or microvalves because they provide substantial mechanical displacement for a given input of thermal energy. However, configurations which have moveable edges are especially susceptible to damage and failure at the exposed actuator edges from chemical interactions between the materials of the actuator and components or impurities in the working fluid used.

The thermal expansion gradients which cause the desired movement of the actuator member may be generated by temperature gradients, by materials changes, layers, which expand differently at elevated temperatures, or by a combination of both effects during a thermal cycle. It is advantageous for pulsed thermal actuators to be able to establish and dissipate thermal expansion gradients quickly, so that the actuator can be cycled at a high rate. The thickness and thermal conductivity of each actuator layer, and passive heat conduction pathways are very important considerations in the design and fabrication of an energy efficient device.

Methods of manufacturing thermal actuators for liquid control devices are needed which successfully accommodate requirements for low cost, mechanical performance, thermal efficiency, and chemical reliability in the face of chemically active working fluids.

Liquid drop emitters require a highly accurate nozzle opening which communicates to a liquid chamber in which the moveable thermal actuator generates drop emission pressures. In many applications, such as ink jet printheads, large numbers of drop emitters, jets, are fabricated in spatially dense arrays in order to achieve high printing speeds and image quality. Such arrays of jets are only useful if the individual nozzles are extremely uniform in their geometrical parameters, especially shape, bore length, and surface planarity. In addition, maintenance of drop emission performance during use may require periodic wiping of the nozzle face area. The strength and topography of the liquid chamber and nozzle wall are important contributors to the design of a reliable ink printhead and printhead maintenance subsystem combination.

Methods of manufacturing liquid control devices are needed which integrate strong chamber structures in which the actuator moves freely against the working fluid. In addition, methods of manufacturing liquid chamber structures which integrate highly accurate and uniform liquid exit nozzles are needed for thermally actuated liquid drop emitters, especially ink jet printheads.

Recently, disclosures of thermo-mechanical DOD ink jet configurations and methods of manufacture have been made by K. Silverbrook in U.S. Pat. Nos. 6,067,797; 6,087,638; 6,180,427; 6,217,153; and 6,228,668 (hereinafter, "the Silverbrook patents"). A variety of microelectronic materials, processes and process sequences are described. However, the disclosed fabrication methods do not address the need to form thermal actuators which combine thermal efficiency and protection of the actuator materials from chemical interactions. The disclosed manufacturing methods and materials do not allow the use of high temperature deposition processes for layers which need to have contact with the ink jet ink. Also, the disclosed manufacturing methods do not provide for a liquid chamber structure which is suited for the formation of dense arrays of jets having highly uniform nozzles. Further, the disclosed manufacturing methods result in drop emitter devices having nozzle faces with topographical features that may trap debris and be difficult to maintain via wiping methods.

Methods of manufacturing thermally actuated liquid control devices, especially liquid drop emitters, are needed which combine the features of low cost microelectronic fabrication processes and materials, thermally efficient design, wet chemical passivation, and mechanically robust liquid chamber structures with accurately formed, maintainable, nozzles.

SUMMARY OF THE INVENTION

It is therefore an object of the present invention to provide a method of manufacturing a thermal actuator having free edges for a liquid control device which is thermally efficient and protected from chemical interactions with the working liquid.

It is also an object of the present invention to provide method of manufacturing a movement volume, especially a liquid chamber, which can be integrally formed with a thermal actuator.

It is further an object of the present invention to provide a method of manufacturing a strong liquid chamber for a liquid drop emitter, especially an ink jet printhead, which has accurately formed nozzle openings and can be integrally formed with a thermal actuator.

The foregoing and numerous other features, objects and advantages of the present invention will become readily apparent upon a review of the detailed description, claims and drawings set forth herein. These features, objects and advantages are accomplished by a method for manufacturing a thermal actuator for a micro-electromechanical device comprising the steps of forming a bottom layer of a bottom material on a substrate having a flat surface and composed of a substrate material, and removing the bottom material in a bottom layer pattern wherein a moveable area located between opposing free edges remains on the substrate. A deflector layer of a deflector material is formed over the bottom layer and patterned so that the deflector material does not overlap the free edges of the bottom layer material. A top layer of a top material is formed over the deflector layer, the bottom layer, and the substrate and patterned so that the top material overlaps the deflector layer material but does not completely overlap the substrate material in the free edge area. A layer of a sacrificial material is conformed over the top, deflector, bottom layers and substrate in sufficient thickness to result in a planar sacrificial layer surface parallel to the flat surface. The sacrificial material is patterned so that sacrificial material remains in movement areas and adjacent free edge areas. A structure layer of a structure material is formed over the sacrificial layer and patterned to have openings which expose the sacrificial material in movement areas. The substrate material beneath the moveable area is removed so that the free edges of the bottom layer are released from the substrate and the exposed sacrificial material is removed from the movement areas and free edge areas thereby creating a movement volume for the thermal actuator. High temperature microelectronic fabrication processes may be used for forming the bottom, deflector and top layer materials. The openings in the structure material may serve as nozzles for a liquid drop emitter or as inlet or outlet ports for a microvalve.

The present invention is particularly useful to construct liquid drop emitters used as printheads for DOD ink jet printing. In some preferred embodiments of the inventions, the deflector layer of the thermal actuator may be formed with an electrically resistive material, especially titanium aluminide, the bottom layer may be formed by oxidation of the substrate, and the sacrificial material may be non-photoimageable polyimide.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides methods of manufacture for liquid control devices, especially liquid drop emitters and microvalves. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide methods of manufacturing thermal actuators and integrated movement volumes, such as liquid chambers, having input and output openings which can serve as nozzles, fluid inlet or outlet ports, and fluid supply entrances.

Figure 1:
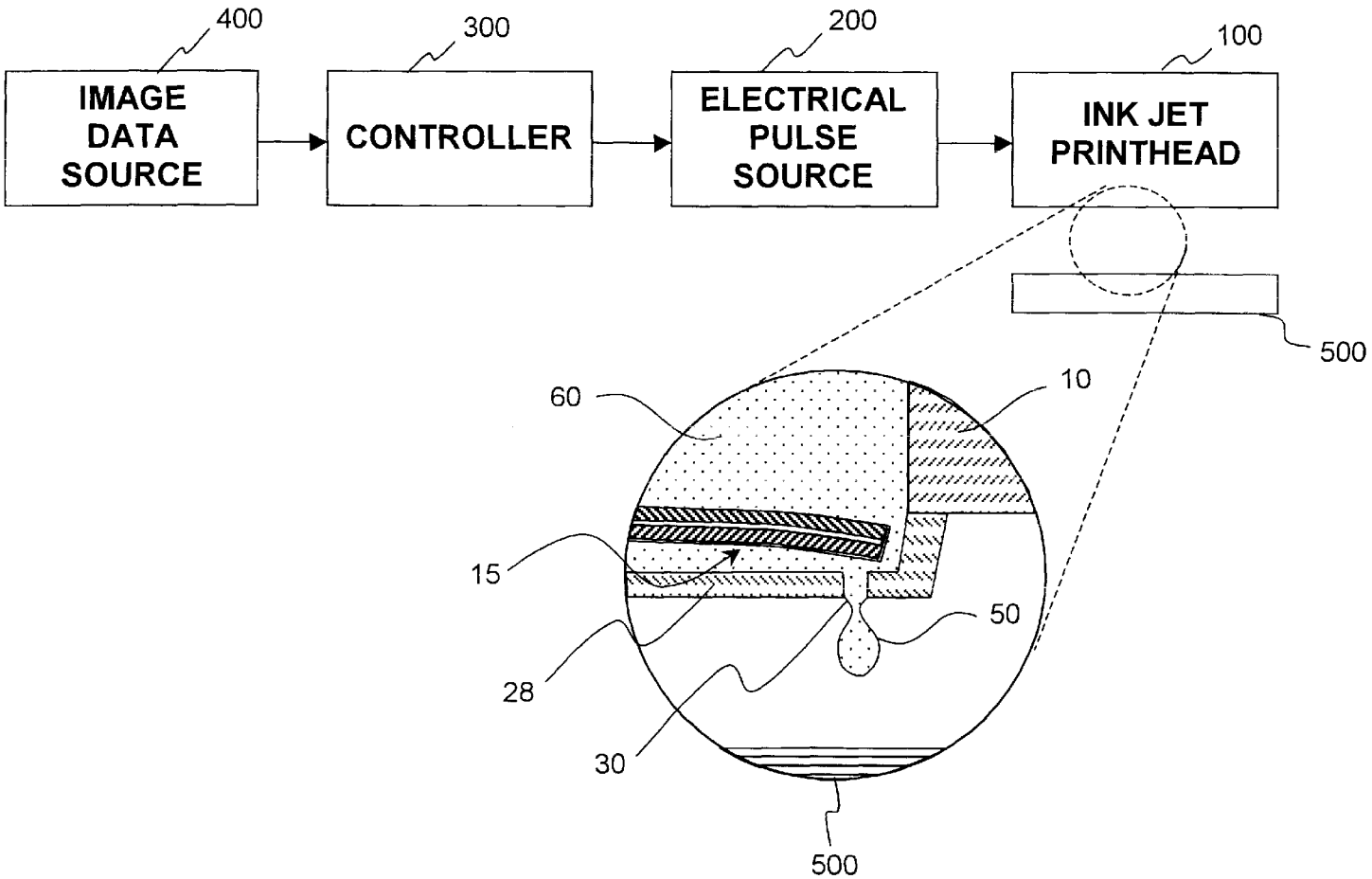
FIG. 1 is a schematic illustration of an ink jet system according to the present invention.

Turning first to FIG. 1, there is shown a schematic representation of an ink jet printing system which may use an apparatus manufactured by methods according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500.

Figure 2:
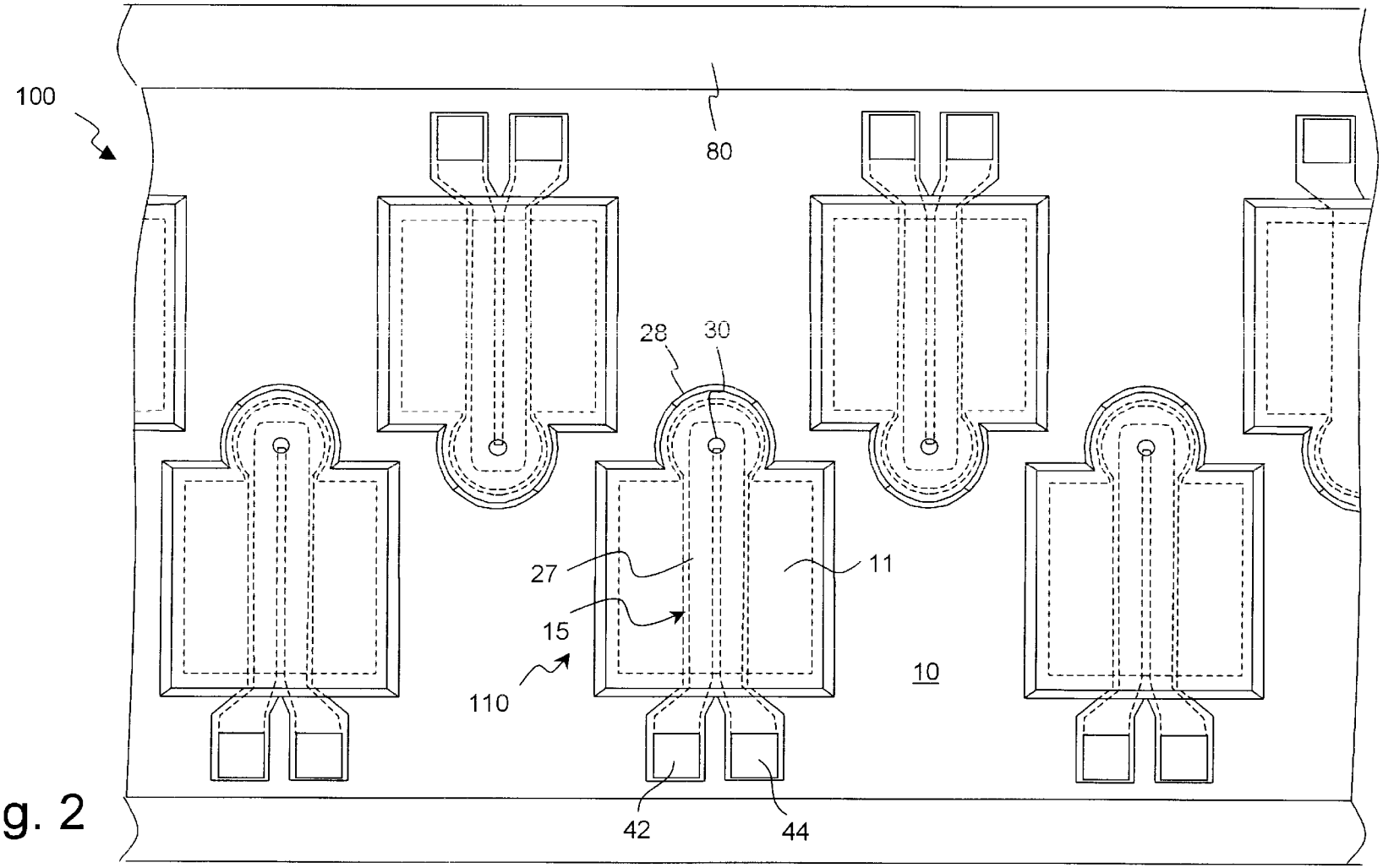
FIG. 2 is a plan view of an array of ink jet units or liquid drop emitter units utilizing cantilevered thermal actuators according to the present invention.

FIG. 2 shows a plan view of a portion of ink jet printhead 100. An array of thermally actuated ink jet units 110 is shown having nozzles 30 centrally aligned, and ink chambers 11, interdigitated in two rows. The ink jet units 110 are formed on and in a substrate 10 using microelectronic fabrication methods as described herein.

Each drop emitter unit 110 has associated electrical lead contacts 42, 44 which are formed with, or are electrically connected to, a u-shaped electrically resistive heater 27, shown in phantom view in FIG. 2. In the illustrated embodiment, the resistor 27 is formed in a deflector layer of thermal actuator 15 and participates in the thermo-mechanical effects. Element 80 of the printhead 100 is a mounting structure which provides a mounting surface for microelectronic substrate 10 and other means for interconnecting the liquid supply, electrical signals, and mechanical interface features.

Figure 3A:
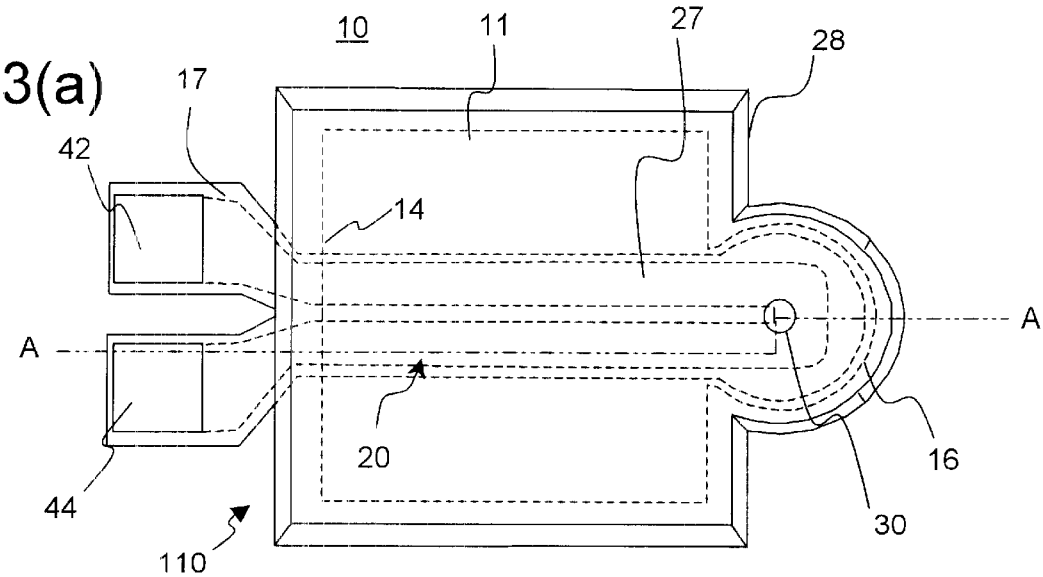
FIG. 3 is an enlarged plan view of an individual ink jet unit shown in FIG. 2.
Figure 3B:
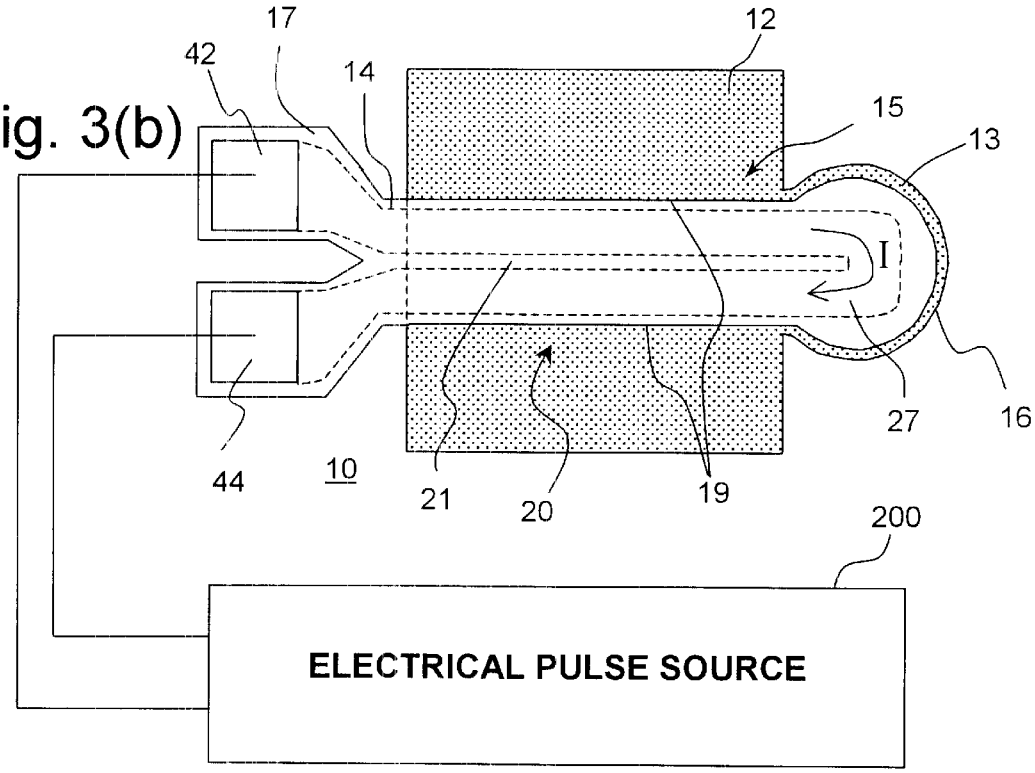

FIG. 3*a* illustrates a plan view of a single drop emitter unit 110 and a second plan view FIG. 3*b* with the liquid chamber structure 28 enclosing movement volume 11 and including nozzle 30, removed.

The thermal actuator 15, shown in phantom in FIG. 3*a* can be seen with solid lines in FIG. 3*b*. The cantilevered element 20 of thermal actuator 15 extends from edge 14 of lower liquid chamber 12 which is formed in substrate 10. Cantilevered element portion 17 is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators which can be used, many other shapes are applicable. The paddle shape aligns the nozzle 30 with the center of the actuator free end. The fluid chamber 12 has a curved wall portion at 16 which conforms to the curvature of the actuator free end, spaced away to provide a clearance gap 13 for the actuator movement. The opposing free edges 19 of the thermal actuator define a moveable area 21 of the cantilevered element 20.

FIG. 3*b* illustrates schematically the attachment of electrical pulse source 200 to the electrically resistive heater 27 at interconnect terminals 42 and 44. Voltage differences are applied to voltage terminals 42 and 44 to cause resistance heating via u-shaped resistor 27. This is generally indicated by an arrow showing a current I. In the plan views of FIG. 3, the actuator free end moves toward the viewer when pulsed and drops are emitted toward the viewer from the nozzle 30 in liquid chamber structure 28. This geometry of actuation and drop emission is called a "roof shooter" in many ink jet disclosures.

Figure 4:
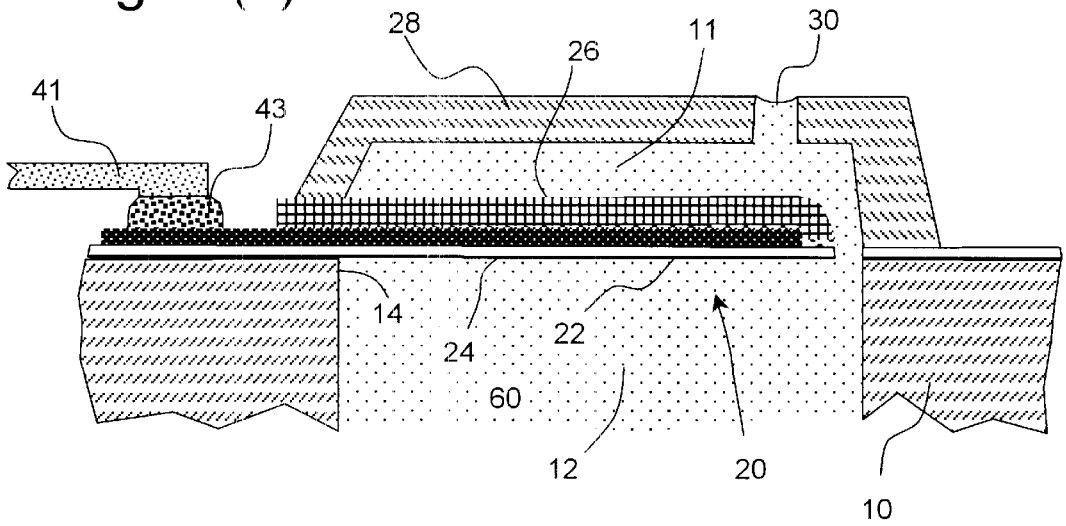
FIG. 4 is a side view illustrating the movement of a cantilevered element thermal actuator according to the present invention.
Figure 4:
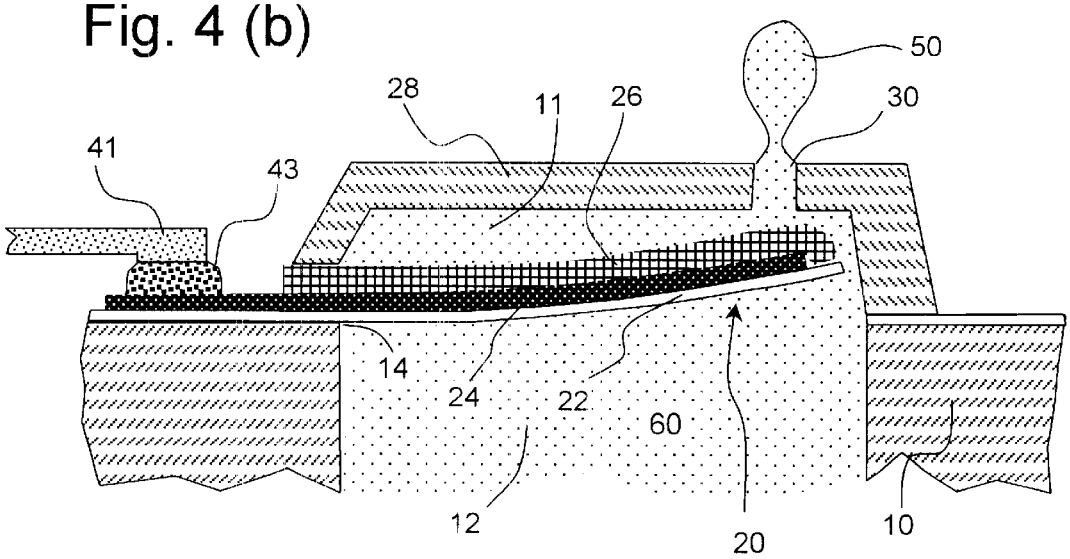

FIG. 4 illustrates in side view a cantilevered element 20 according to a preferred embodiment of the present invention. In FIG. 4*a* the cantilevered element 20 is in a first position and in FIG. 4*b* it is shown deflected upward to a second position. Cantilevered element 20 is anchored to substrate 10 which serves as a base element for the thermal actuator. Cantilevered element 20 extends from wall edge 14 of substrate base element 10.

Cantilevered element 20 is constructed of several layers. Layer 24 is the deflector layer which causes the upward deflection when it is thermally elongated with respect to other layers in the cantilevered element. The deflector material is chosen to have a high coefficient of thermal expansion. Further, in the illustrated configuration, the deflector material is electrically resistive and a portion is patterned into a heater resistor for receiving electrical pulses to heat the thermal actuator. Electrically resistive materials are generally susceptible to chemical interaction with components or impurities in a working fluid.

Top layer 26 is formed with a top material having a substantially lower coefficient of thermal expansion than the deflector material and has a layer thickness which is on the order of, or larger than, the deflector layer thickness. Top layer 26 in FIG. 4 does not expand as much as the deflector layer when heated thereby constraining the deflector layer from simply elongating and causing the overall cantilevered element 20 to bend upward, away from deflector layer 24. For embodiments wherein the deflector material is electrically resistive and formed with a heater resistor, the top layer material is a dielectric. The top layer material is also chosen to be chemically inert to the working fluid.

Bottom layer 22 is formed of a bottom material which is chemically inert to the working fluid being used with the device, for example, an ink for ink jet printing. It protects the lower surface of the deflector material from chemical interaction. In addition, the bottom material serves as an etch stop during a manufacturing process step described hereinbelow in which substrate material is removed beneath the thermal actuator.

The terms "top" and "bottom" are chosen to reference layers with respect to position relative to the substrate. These layers also play a role in determining which direction the deflector layer causes the thermal actuator to bend. If both layers were formed of the same materials of equal thickness, the actuator might not bend at all. The deflector layer will be caused to bend towards whichever layer, top or bottom, is more constraining as a result of its thickness, thermal expansion coefficient and Young's modulus. The biasing of the movement direction is most easily achieved by making the layer which is toward the desired direction substantially thicker than the away layer. Consequently, some liquid control devices manufactured by the methods of the present inventions discussed herein will be made with a thin top layer and a thick bottom layer, and others will be made with the reverse.

When used as actuators in drop emitters the bending response of the cantilevered element 20 must be rapid enough to sufficiently pressurize the liquid at the nozzle. Typically, electrically resistive heating apparatus is adapted to apply heat pulses and an electrical pulse duration of less than 10 $\mu$secs. is used and, preferably, a duration less than 2 $\mu$secs.

Figure 5:
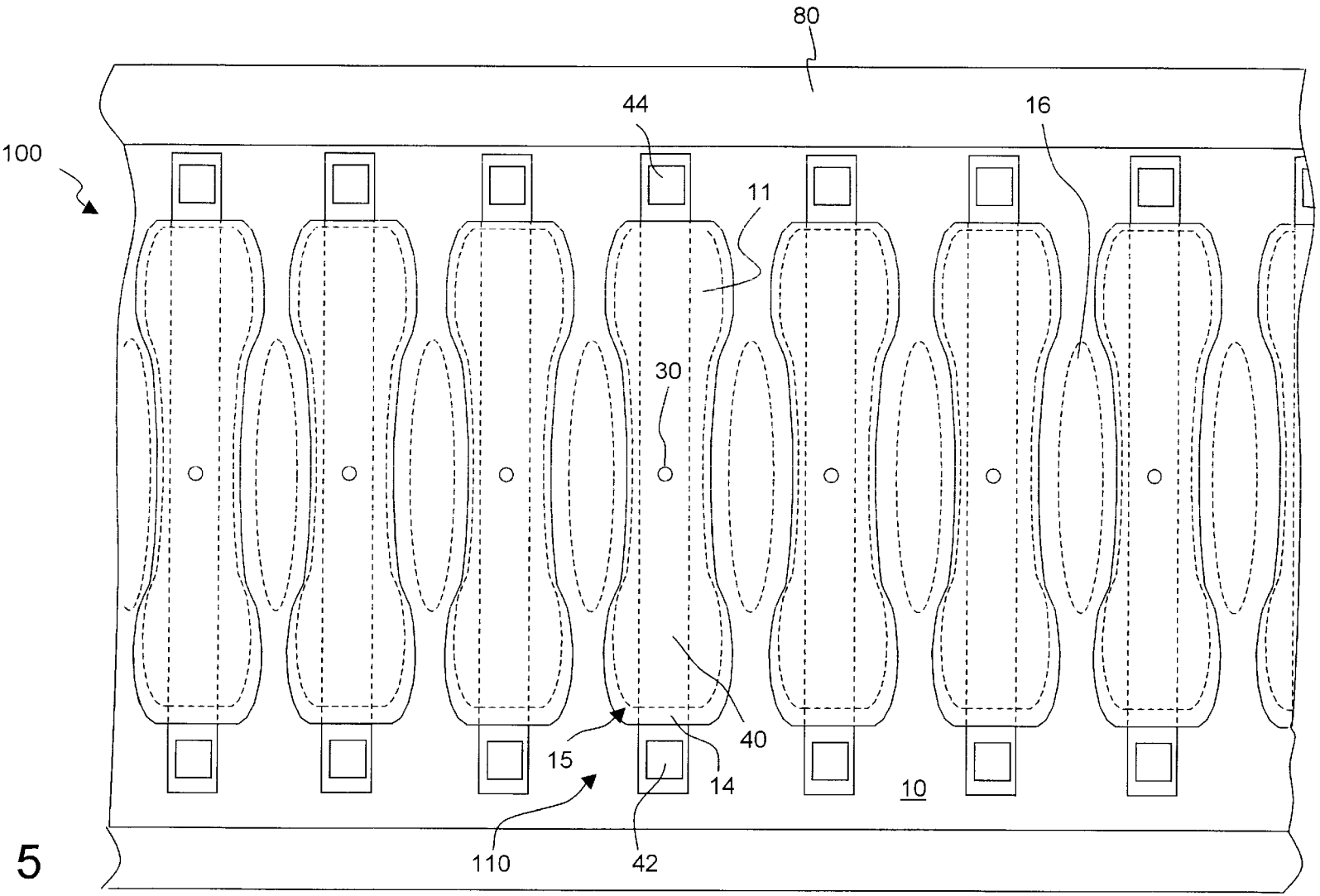
FIG. 5 is a plan view of an array of ink jet units or liquid drop emitter units utilizing buckling member thermal actuators according to the present invention.

FIG. 5 shows a plan view of a portion of ink jet printhead 100 designed using a buckling member 40, configured as a beam anchored at two ends. Devices constructed using this configuration of the moveable portion of a thermal actuator will be described using like number labels and descriptive terms for analogous elements as were used for the cantilevered element configuration previously discussed. An array of thermally actuated ink jet units 110 is shown having nozzles 30 centrally aligned, and upper ink chambers 11, arranged in a single row. The ink jet units 110 are formed on and in a substrate 10 using microelectronic fabrication methods as described herein.

Each drop emitter unit 110 has associated electrical lead contacts 42, 44 which are electrically connected to a linear resistive heater formed in a deflector layer of the thermal actuator 15. Element 80 of the printhead 100 is a mounting structure which provides a mounting surface for microelectronic substrate 10 and other means for interconnecting the liquid supply, electrical signals, and mechanical interface features.

Figure 6A:
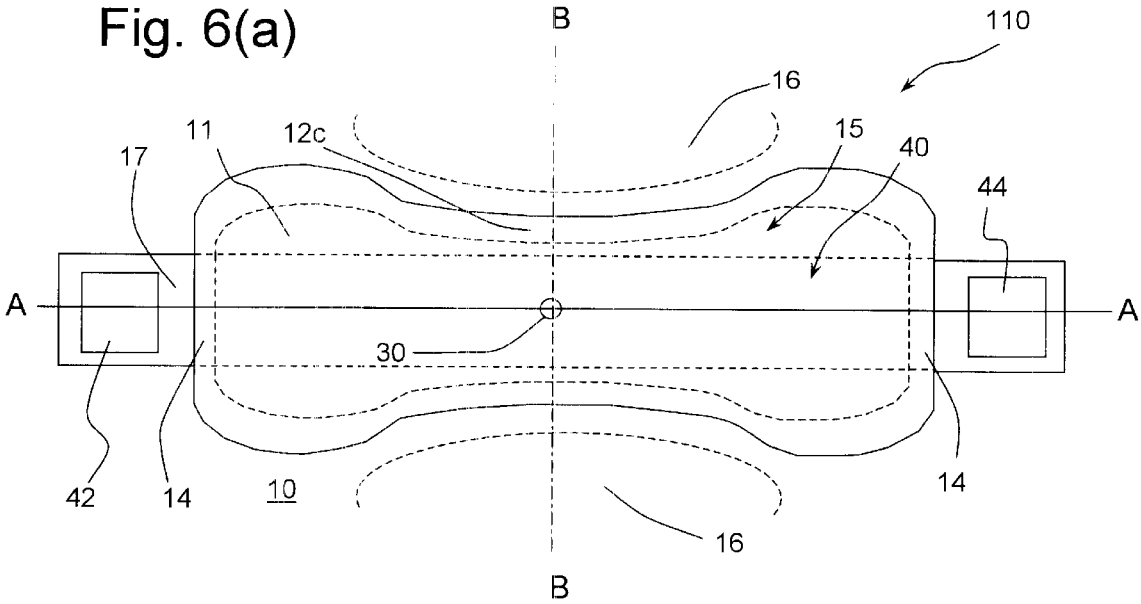
FIG. 6 is an enlarged plan view of an individual ink jet unit shown in FIG. 5.
Figure 6B:
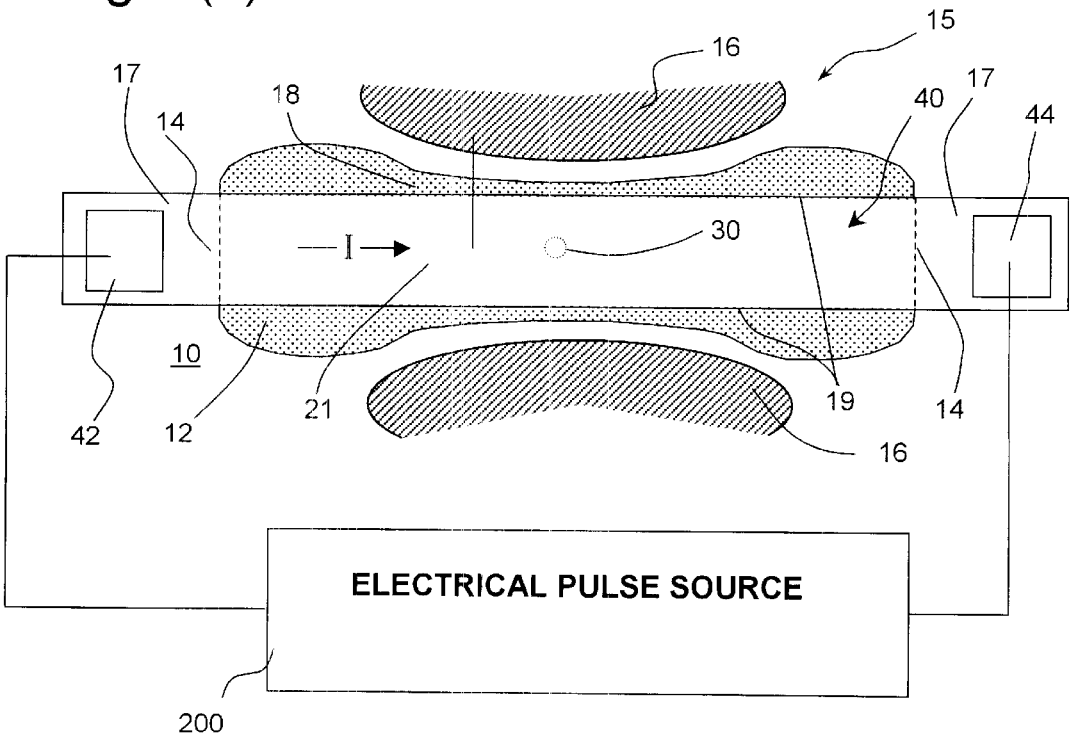

FIG. 6*a* illustrates a plan view of a single drop emitter unit 110 and a second plan view FIG. 6*b* with the liquid chamber structure 28 enclosing movement volume II and including nozzle 30, removed. The thermal actuator 15, shown in phantom in FIG. 6*a* can be seen with solid lines in FIG. 6*b*. The buckling member 40 of thermal actuator 15 extends from opposing edges 14 of lower liquid chamber 12 which is formed in substrate 10. Portion 17 of buckling member 40 is bonded to substrate 10 anchoring the beam at two points.

The buckling member 40 of the actuator has the shape of a flat beam of uniform width extending across the lower portion of the liquid chamber. The liquid chamber is narrowed in the center area 12c near nozzle 30. This shape is merely illustrative of buckling member actuators which can be used, many other shapes are applicable. The opposing free edges 19 of the thermal actuator define a moveable area 21 of the buckling member 40.

FIG. 6*b* illustrates schematically the attachment of electrical pulse source 200 to linear resistive heater 27 at interconnect terminals 42 and 44. Resistive heater 27 is simply the deflector layer formed within the buckling member. Voltage differences are applied to voltage terminals 42 and 44 to cause resistance heating generally indicated by an arrow showing a current I. In the plan views of FIG. 6, the actuator buckles upward toward the viewer when pulsed and drops are emitted toward the viewer from the nozzle 30 in liquid chamber structure 28.

Figure 7A:
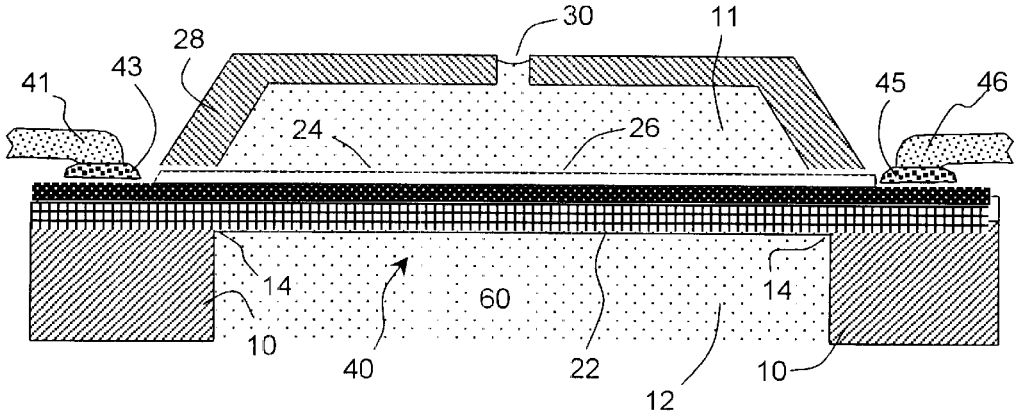
FIG. 7 is a side view illustrating the movement of a buckling member thermal actuator according to the present invention.
Figure 7B:
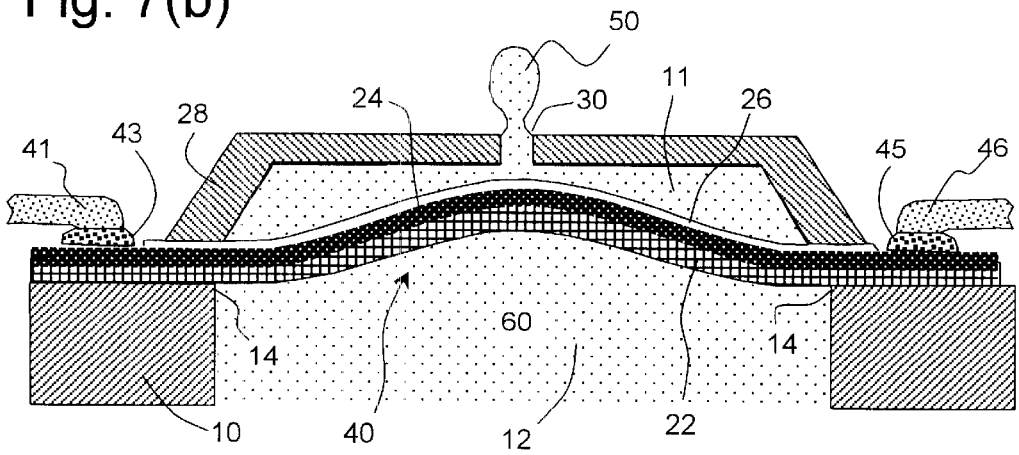

FIG. 7 illustrates in side view a buckling member thermal actuator according to a preferred embodiment of the present invention. In FIG. 7*a* the actuator is in a first position and in FIG. 7*b* it is shown buckled upward to a second position. Buckling member 40 is anchored to substrate 10 which serves as a base element for the thermal actuator. Buckling member 40 extends from wall edges 14 of substrate base element 10.

The device configuration illustrated in FIGS. 5-7 requires the buckling member 40 to deflect upwards to pressurize the ink and eject an ink drop.

Deflector layer 24, bottom layer 22 and top layer 26 are formed of materials having the same properties as described above with respect to cantilevered element 20 in FIG. 4. However for this buckling member configuration wherein the beam is constrained on two ends, top layer 26 is formed as a thin layer and bottom layer 22 is formed with sufficient thickness to constrain the deflector layer 24. The bottom layer 22 now performs the role of forcing the deflector layer 24 to elongate by deforming upward, bending around the bottom layer. Some applications, such as the normally closed valve discussed below and illustrated in FIG. 17, require a downward buckling member. For these applications, bottom layer 22 is formed as a thin layer and top layer 26 is formed to be of comparable thickness to deflector layer 24.

Figure 14:
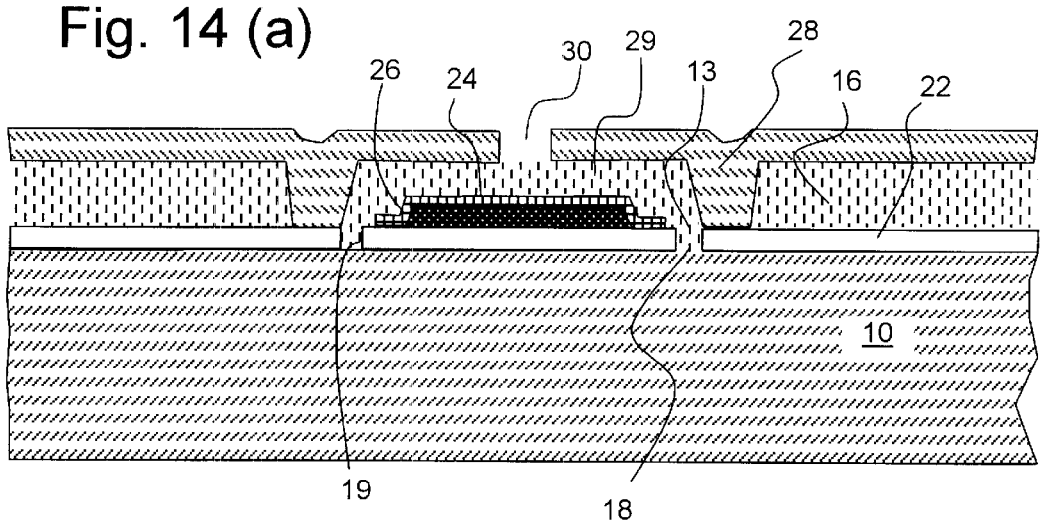
FIG. 14 is a side view of final stages of the manufacturing method according to the present inventions applied to an alternate thermal actuator configuration wherein a movement volume and liquid chamber is created by removing sacrificial material, sacrificial material is left in structure areas, and the thermal actuator is released and the fluid pathway completed by removing substrate material beneath the moveable and free edge areas.
Figure 14:
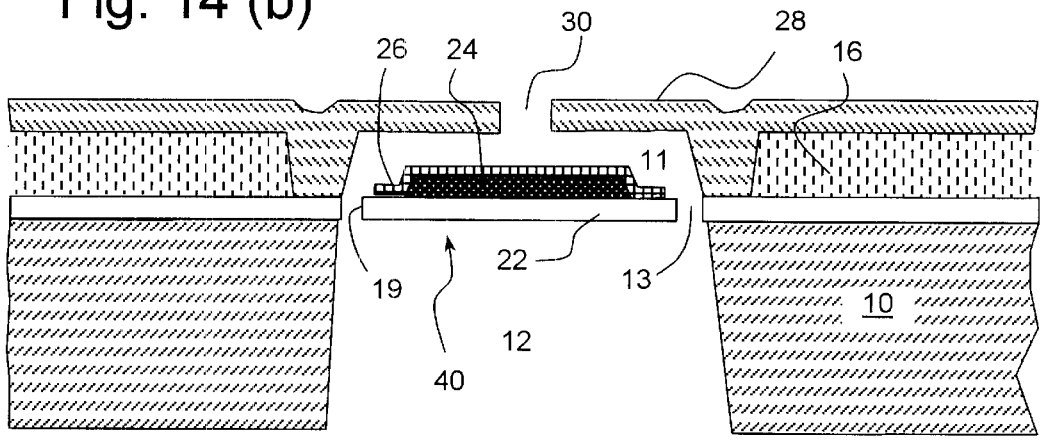
Figure 15:
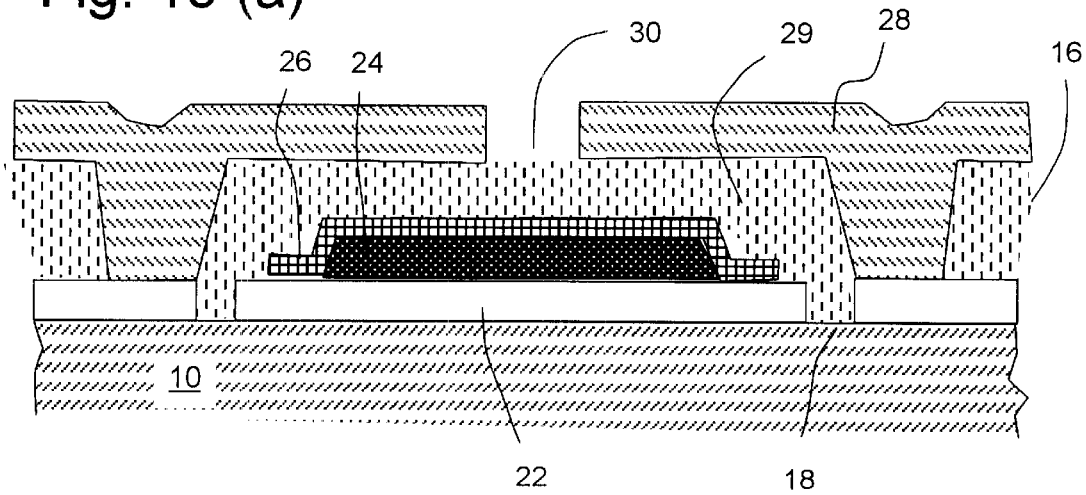
FIG. 15 is a side view illustrating three alternate approaches to the overlap of top, deflector and bottom layers in the free edge area according to preferred embodiments of the present invention.
Figure 15:
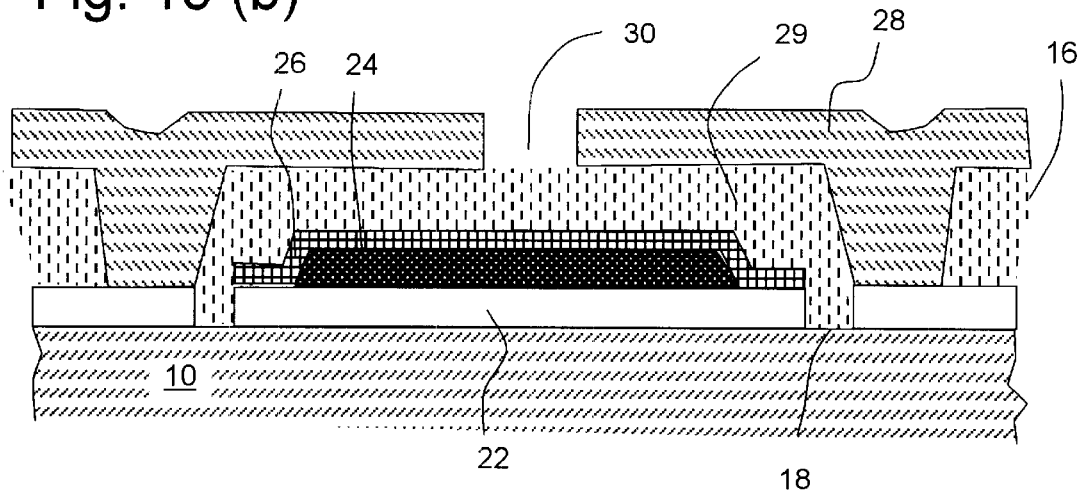
Figure 15:
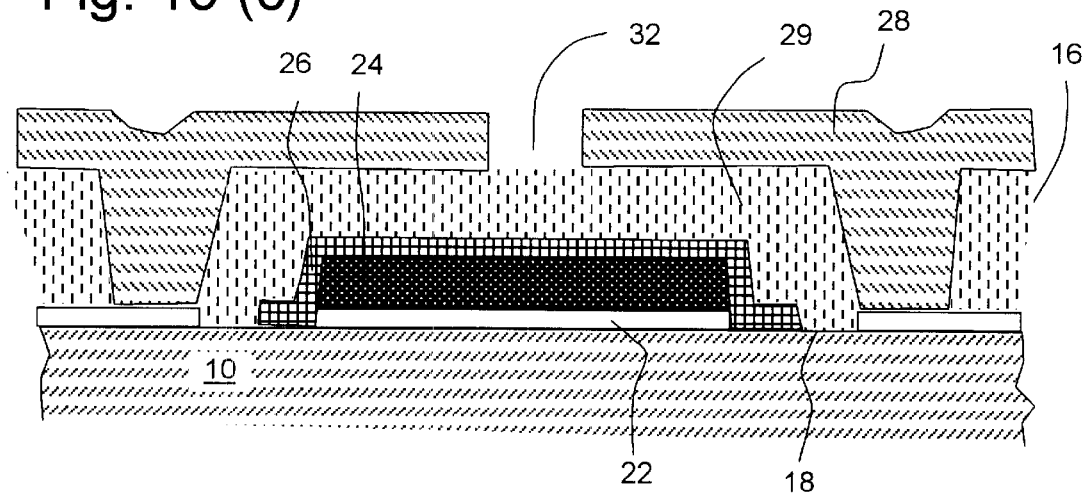

FIGS. 8 through 13 illustrate methods of manufacturing applied to an ink jet device having a cantilevered element thermal actuator, as illustrated in FIGS. 3 and 4. FIGS. 14 and 15 illustrate additional methods of manufacturing using a buckling member thermal actuator ink jet configuration as an example. Taken together, FIGS. 8 through 15 illustrate the methods of manufacturing liquid control devices of the present inventions.

Figure 8:
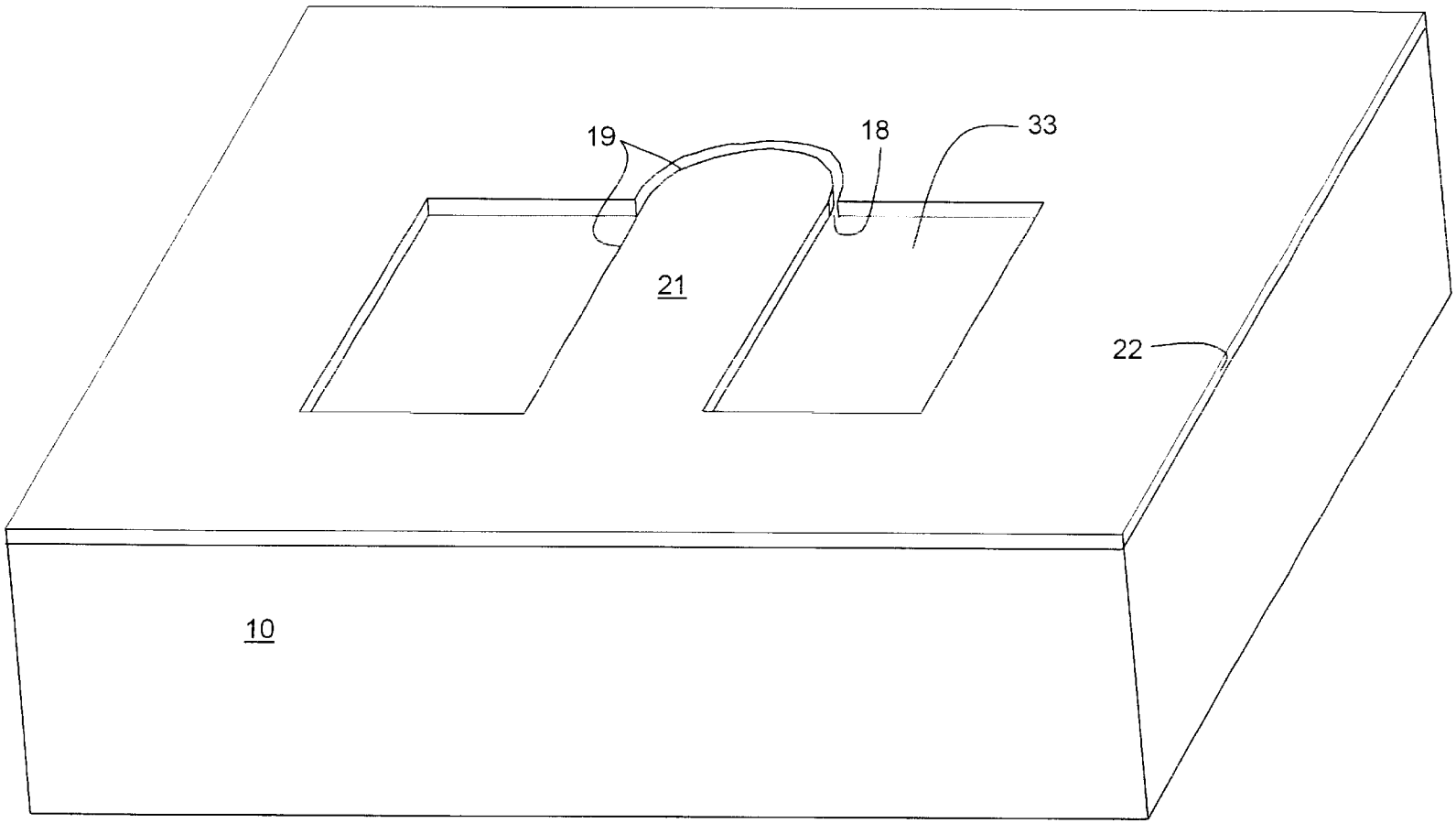
FIG. 8 is a perspective view of a step of the manufacturing method according to the present inventions wherein a bottom layer is formed.

FIG. 8 illustrates a perspective view of a single cantilevered element at an initial stage of a manufacturing process.

Bottom layer 22 has been formed of a bottom material on substrate 10. The bottom material has been removed in a bottom layer pattern so that the substrate is now exposed in some areas. These exposed areas of the substrate will eventually be removed to form portions of the lower liquid chamber 12 and the clearance gap 13 illustrated in FIG. 3*b*. The large rectangular areas of substrate exposure are refill areas 33 which are sized to provide adequate upper chamber refill flow during rapid liquid drop emission, allowing a tightly fitting clearance gap 13 to improve drop ejection efficiency without compromising refill. The moveable portion of the bottom layer 21 has opposing free edges 19. The substrate 10 is exposed in free edge area 18 adjacent the free edges 19 of bottom layer 22.

The bottom material for the cantilevered element thermal actuator is deposited as a thin layer so to minimize its impedance of the upward deflection of the finished actuator. A chemically inert, pinhole free material is preferred so as to provide chemical and electrical protection of the deflector material which will be formed on the bottom layer. A preferred method of the present inventions is to use silicon wafer as the substrate material and then a wet oxidation process to grow a thin layer of silicon dioxide. Alternatively, a high temperature chemical vapor deposition of a silicon oxide, nitride or carbon film may be used to form a thin, pinhole free dielectric layer with properties that are chemically inert to the working fluid.

The silicon substrate material can later be removed by a variety of etching processes, including orientation dependent etching and reactive ion etching. Because the actuator will eventually be released to move by removing the substrate material from beneath the bottom layer, the bottom layer can be formed by a high temperature process. An alternative method disclosed in the Silverbrook patents referenced above, forms the thermal actuator on sacrificial layer materials, such as photoimageable polyimide or aluminum, which cannot withstand high temperature oxidation or chemical vapor deposition processes. Therefore bottom layers must be formed in thicker layers to overcome pinhole problems, thereby reducing both the mechanical and thermal efficiency of the completed thermal actuator.

While FIG. 8 illustrates both the deposition and patterning of the bottom layer, the patterning of the bottom layer may be delayed until after a later step or done simultaneously with a later patterning process.

Figure 9:
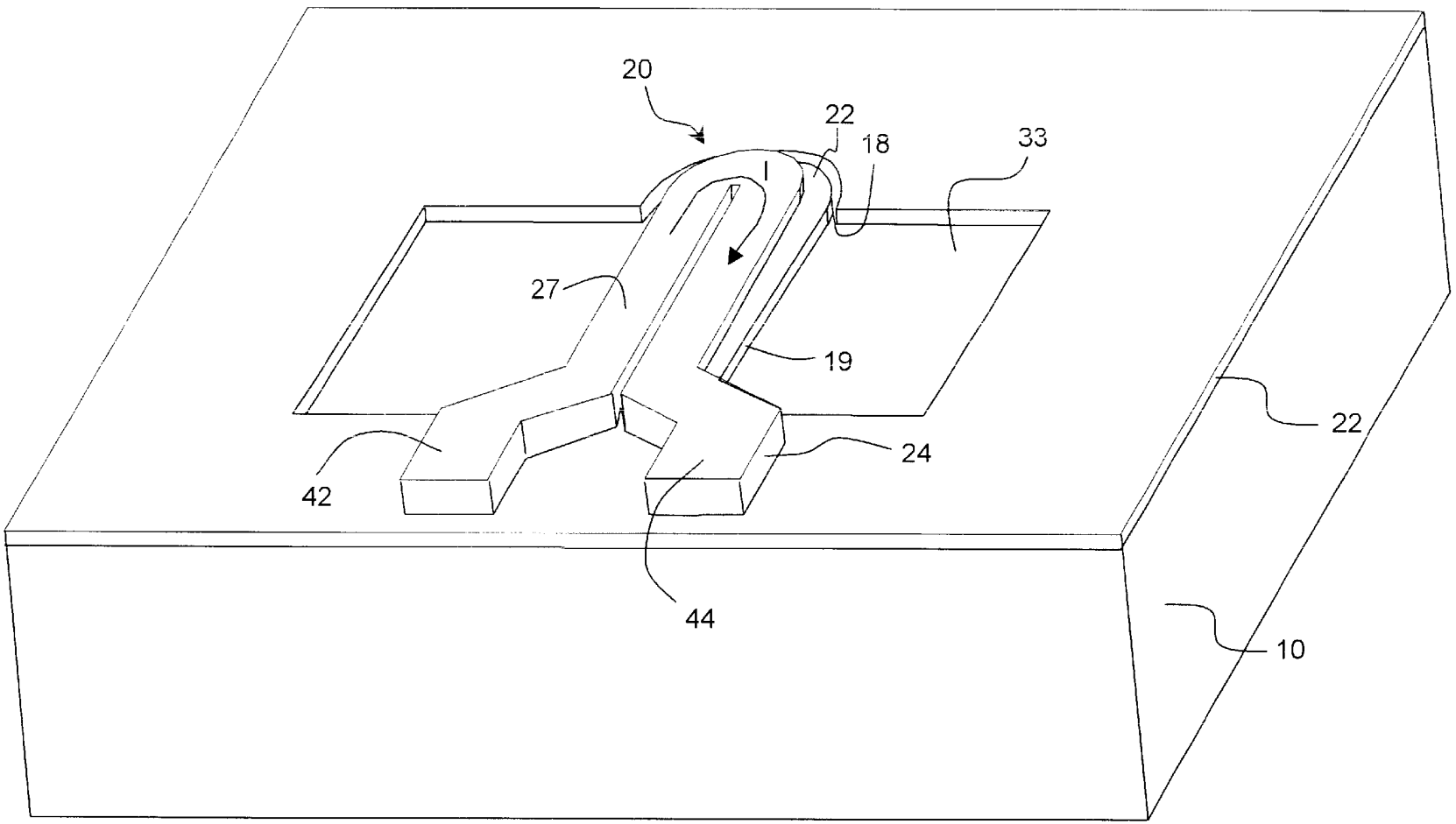
FIG. 9 is a perspective view of a step of the manufacturing method according to the present inventions wherein a deflector layer is formed.

FIG. 9 illustrates the addition of a deflector layer 24 over the previously deposited bottom layer. Deflector material is removed in a deflector layer pattern. In the illustrated configuration, the deflector layer is comprised of an electrically resistive deflector material, a portion of which is patterned into a u-shaped heater resister 27 which can be addressed by input leads 42 and 44. Deflector material is removed so that it does not overlap the bottom layer material. In the design illustrated in FIG. 9, the deflector material is removed well back from edges 19 of bottom layer 22. Alternatively, the deflector layer and the bottom layer could be patterned together using the bottom layer pattern so that both layers coincided at free edges 19. A subsequent patterning of the deflector layer only would then be needed to introduce any unique features such as the resistor and addressing leads.

The deflector material is selected to have a high coefficient of thermal expansion, for example, a metal. In addition, for the examples illustrated herein, the deflector material is electrically resistive and used to form a heater resistor. Nichrome (NiCr). is a well known material which could be used as a deflector material. A 60% copper, 40% nickel alloy, cupronickel, and titanium nitride are disclosed in the Silverbrook patents.

Materials which have, simultaneously, large coefficients of thermal expansion and large Young's moduli, are good candidates for the deflector material. An expression which characterizes the thermo-mechanical efficiency, E of a deflector material is:

$$\varepsilon = \frac{E\alpha}{c_p\rho} \tag{1}$$

where E is the Young's modulus, $\alpha$ is the coefficient of thermal expansion, $c_p$ is the specific heat, and $\rho$ is the density. A material with a higher value of $\epsilon$ will generate more bending force for a given temperature increase than a lower $\epsilon$ material.

An especially efficient and preferred bending material is intermetallic titanium aluminide (TiAl), disclosed in co-pending U.S. patent application Ser. No. 09/726,945 filed Nov. 30, 2000, for "Thermal Actuator", assigned to the assignee of the present invention. TiAl material may be formed by RF or DC magnetron sputtering in argon gas. It has been found that desirable TiAl films are predominantly disordered face-centered cubic (fcc) in crystalline structure and have a stoichiometry of $Al_{4-x}Ti_x$, where $0.6 \leqq x \leqq 1.4$. Such films can have thermo-mechanical efficiencies, $E\epsilon \sim 1.1$. It has been found that the addition of oxygen or nitrogen gas during film deposition has the detrimental effect of lowering the product of the Young's modulus and thermal expansion coefficient, hence the thermo-mechanical efficiency, and should be avoided.

Variation of the substrate bias voltage over the range 0V to 100V can change the residual stress from tensile to compressive. Argon deposition pressures in the range of 5 milliTorr (mT) are preferred. Reduction of the argon pressure below 6 mT causes an increase in compressive stress. For DC magnetron sputtering, varying the pulse duty cycle can also be used to adjust the residual stress. The final stress, hence the residual position of the thermal actuator, can be tailored through proper selection of substrate bias voltage, argon pressure, and pulsing duty cycle, if applicable. In general, a relatively flat residual shape for the cantilevered element or buckling member is desirable. However, some microvalve device designs require a non-flat residual shape. The deposition process for the deflector layer may be carefully adjusted to result in a desired non-flat residual shape for the moveable portion of the thermal actuator.

Titanium aluminide may be pattern etched with a standard chlorine-based dry etching system commonly used in microelectronic device fabrication for aluminum etching.

If the resistivity of the deflector material is in an appropriate range, then a portion of the deflector layer can be patterned as a resister and used to introduce heat pulses to the thermal actuator. Alternatively, a separate electrical resistor layer can be added or heat energy can be coupled to the actuator by other means such as light energy or inductively coupled electrical energy. The titanium aluminide material preferred in the present inventions has a resistivity of ~160 $\mu$ohm-cm. which is a reasonable resistivity for a heater resistor to be pulsed by integrated circuit drive transistors. Typical thicknesses, $h_d$, for the deflector layer are 0.5 $\mu$m to 2 $\mu$m.

Figure 10:
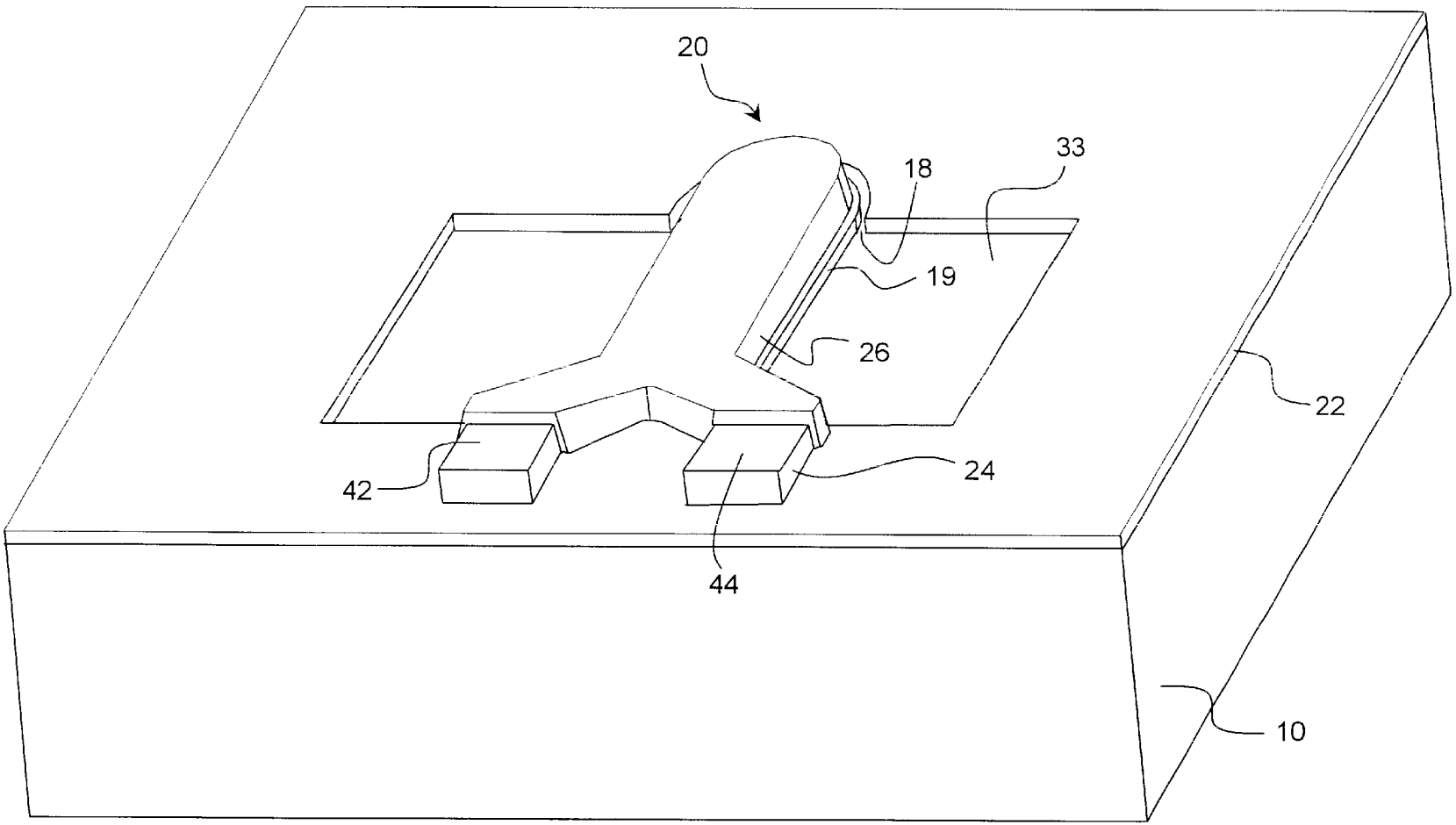
FIG. 10 is a perspective view of a step of the manufacturing method according to the present inventions wherein a top layer is formed.

FIG. 10 illustrates in perspective view the addition of a top layer 26 formed over the deflector layer 24, bottom layer 22, and substrate 10. The top layer is removed in a top layer pattern which generally leaves top layer material covering the deflector material in the moveable area of the cantilevered element. The top layer as illustrated in FIG. 10 performs two main functions, it protects the deflector material from chemical interaction with the working fluid, and it biases the deflection of cantilevered element 20 towards itself. As was discussed before, for some other applications of the present inventions, the top layer may only perform the protective function and the bottom layer the deformation biasing function instead.

To maximize the deflection in a bi-layer thermo-mechanical beam for a given total thickness, the Young's moduli and layer thickness ratio is preferably chosen to have the following relationship:

$$\frac{h_t}{h_d} = \sqrt{\frac{E_d}{E_t}}, \tag{2}$$

where $E_d$ and $E_t$ are the Young's moduli of the deflector and top materials respectively. To increase the force the beam can exert, the top layer is typically made thicker than given by equation 2 to increase the flexural rigidity of the beam. The optimum thickness of the top layer will be determined by the pressures encountered during drop emission. For the upward bending cantilevered element 20 illustrated, the top layer is deposited with a thickness that is on the order of, or greater than, the deflector layer thickness. That is, the top layer will have a thickness, $h_1$, of ~1 $\mu$m to 3 $\mu$m. The Young's modulus of titanium aluminide is ~188 GPa.

A typical dielectric material used for the top material is silicon dioxide or silicon nitride. Many other dielectrics may be used. In the configuration of FIG. 10 wherein the top layer is relatively thick, oxides and nitrides deposited by low temperature CVD processes will provide substantial chemical interaction protection for the deflector layer. For other configurations wherein the top layer must be thin, a balance must be struck between the process temperature of the top material deposition and any adverse affects on the properties of the previously deposited deflector material. A high temperature top material deposition process which can create pinhole free passivation is preferred.

The inventors of the present inventions have measured a Young's modulus for silicon oxide deposited by PECVD of 74 Gpa. For silicon nitride deposited by PECVD a Young's modulus of 170 Gpa has been measured. Successful cantilevered element configuration liquid drop emitters have been made having a thermal silicon dioxide bottom layer thickness $h_b$=0.2 $\mu$m, a titanium aluminide deflector layer thickness, $h_d$=0.8 $\mu$m, and a silicon oxide top layer thickness, $h_t$=2.0 $\mu$m. Similarly, successful cantilevered element configuration liquid drop emitters have been made having a thermal silicon dioxide bottom layer thickness $h_b$=0.2 $\mu$m, titanium aluminide deflector layer thickness, $h_d$=0.8 $\mu$m, and a silicon nitride top layer thickness, $h_t$=1.2 $\mu$m.

The top layer pattern leaves top material covering the free edges of the deflector layer so as to provide chemical and electrical passivation. Further, the top material free edges may underlap, overlap or be coincident with bottom layer free edges 19. An underlapping condition is illustrated in FIG. 10. If the top material is allowed to overlap the bottom material into free edge area 18 on substrate 10, it cannot be allowed to completely cover free edge area 18. Some portion of free edge area 18 adjacent the free edges 19 of cantilevered element 20 must remain so that a subsequent process step of removing the substrate beneath free edge area 18 is effective in releasing the moveable portion of the cantilevered element 20 from attachment to the substrate.

The patterning of top layer 26 completes the construction of the cantilevered element 20 for the liquid drop emitter 110 being discussed. Other layers may be added for other purposes, for example a separate layer and insulator to form a resistive heater, instead of using the deflector material for this function. Also, the top, deflector and bottom layers may be comprised of sub-layers or layers with graded material properties. Such additional layers and features are known and comprehended by the inventors as being within the scope of the methods of manufacture of the present inventions.

Figure 11:
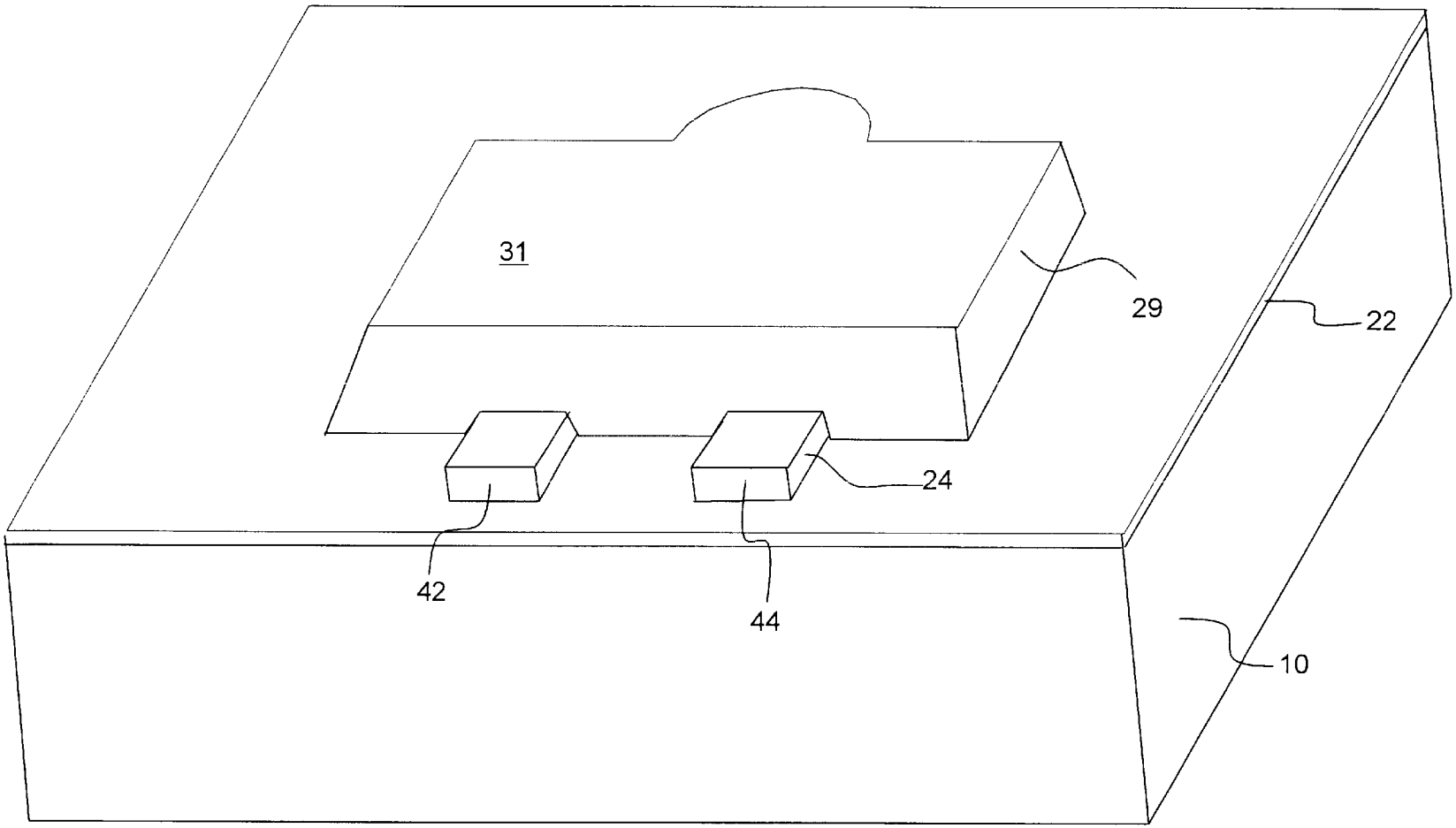
FIG. 11 is a perspective view of a step of the manufacturing method according to the present inventions wherein a sacrificial layer is formed.

FIG. 11 shows the addition of a sacrificial layer 29 formed of a sacrificial material and removed in a sacrificial layer pattern. The sacrificial layer pattern leaves the sacrificial material formed into the shape of the interior of an upper liquid chamber 11 of a liquid drop emitter. For a generalized liquid control device concept, this chamber space can be understood as a movement volume for the thermal actuator. By movement volume it is meant the space into which the moveable portion of the thermal actuator can travel freely without being impeded by structural elements.

The sacrificial material is intended as a temporary form whose outer surface shape will become the inner surface shape of the structure layer which is to be next added. In addition the sacrificial material must be able to fully conform to the underlying layered structure of the cantilevered element including making good contact with the free edge area 18 on substrate 10.

It is also very important that the upper surface 31 of the movement volume 11 be smooth, planar and parallel to the substrate surface. This is so that the structure layer, which is formed over the sacrificial layer, forms a suitable cover or roof for the formation of openings which serve as nozzles and outlet ports. If the upper surface 31 has defects, thickness variations and non-parallelicity, then arrays of liquid drop emitter nozzles used for ink jet printing cannot be formed with high yield. The print quality of an ink jet printhead depends critically on the uniformity of the velocity, volume and firing direction of the drops emitted from all of the nozzles in a printhead.

The Silverbrook patents disclose the use of aluminum or photo-imageable polyimide as sacrificial materials suitable for forming an upper liquid chamber volume. However, these material are deficient in providing the conformity and planarity needed for high yield device manufacturing. Aluminum cannot be reliably deposited in layers thick enough to planarize the underlying sacrificial layer topographies of practical devices.

The inventors of the present inventions have tested the viability of photoimageable polyimide as a sacrificial material suitable for forming an upper liquid chamber volume. It was found that developed and cured photoimageable polyimide produces a sacrificial layer with peaks and valleys of the order of >1 $\mu$m deep around feature edges in the pattern, which will be replicated into the liquid chamber cover where nozzles are to be formed. It was also found that pattern sidewalls of developed and cured photoimageable polyimide are non-vertical and have a slope typically <70 degrees which is not controllable and can vary. Further, because the photoimageable polyimide shrinks in thickness by a factor of 2, resolved features for chamber heights of 8–10 $\mu$m are limited to >10 $\mu$m.

It has been found by the inventors of the present inventions that non-photoimageable polyimide is preferable as a sacrificial material to produce the patterned sacrificial layer characteristics necessary for high yield, multi-jet ink jet printheads. Non-photoimageable polyimide can be applied in thick layers which conform to all of the underlying features as illustrated at the end of the top layer patterning in FIG. 10. Fully cured non-photoimageable polyimide forms a smooth surface uniformly parallel to the starting substrate surface. Patterning is then done by masking the polyimide using a thin silicon oxide layer and dry etching by reactive ion or plasma etching to result in sacrificial layer 29 illustrated in FIG. 11. Well-aligned vertical sidewalls are achieved using this method. Feature resolution using this technique is <1 $\mu$m.

Any material which can be selectively removed with respect to the adjacent materials, fully conforms to the underlying topography down to the free edge area 18, and remains smooth and planar after patterning and curing is a candidate for constructing sacrificial layer 29.

Figure 12:
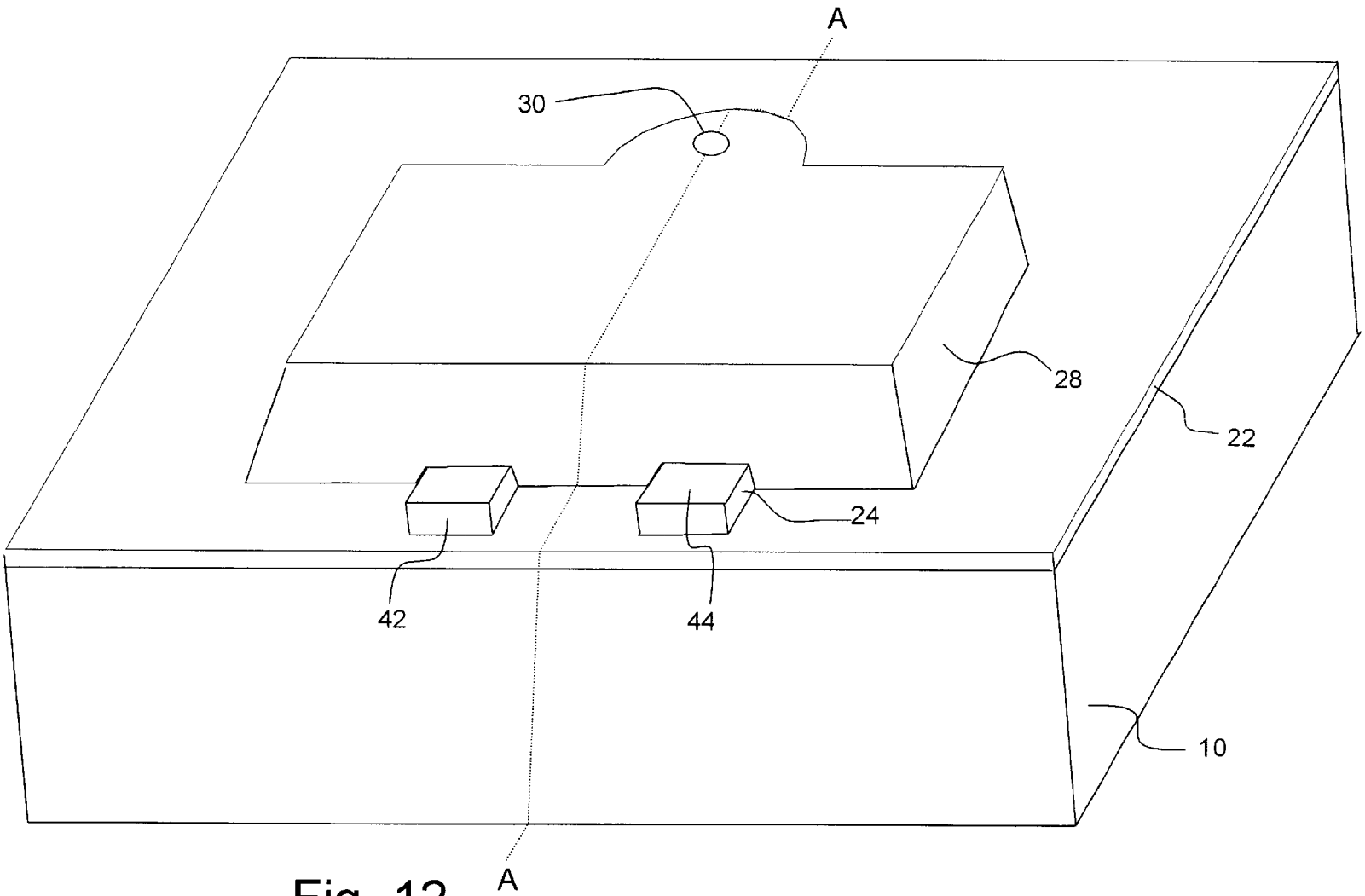
FIG. 12 is a perspective view of a step of the manufacturing method according to the present inventions wherein a structure layer is formed.

FIG. 12 illustrates a structure layer 28 formed by a structure material deposited over the sacrificial layer and other exposed layers on the substrate. Structure material is then removed according to a structure layer pattern resulting in the drop emitter liquid chamber 28 with walls, cover and nozzle 30, illustrated in FIG. 12. In generic liquid control device terms, the completed structure layer 28 contains the movement volume 11 and provides a structure opening 30 which communicates with the sacrificial material still occupying the movement volume space. Electrical leads 42 and 44 are exposed for electrical attachment to a electrical pulse source.

Suitable structure materials include plasma deposited silicon oxides or nitrides. The structure material must conform to the rather deep topography of the completed sacrificial layer 29. The sacrificial layer ranges in height above the substrate from ~1 $\mu$m in the area around electrical leads 42, 44 up to 5 $\mu$m–10 $\mu$m at the upper surface of movement volume 31 (see FIG. 11). The structure material must also be chemically inert to the working fluid and mechanically strong and durable enough to withstand drop ejection pressure pulses and some mechanical wiping for printhead maintenance purposes. In the case of a microvalve application, the structure material must withstand the repeated action of a valve closing member pressing against the structure opening, now an outlet port.

In the case of an ink jet printhead, the structure layer thickness cannot be too large relative to the nozzle diameter, which is largely determined by the desired drop size. If the structure layer is too thick, the nozzle bore will be long and fluid impedance effects will diminish drop velocity and drop repetition frequency capability.

Figure 13:
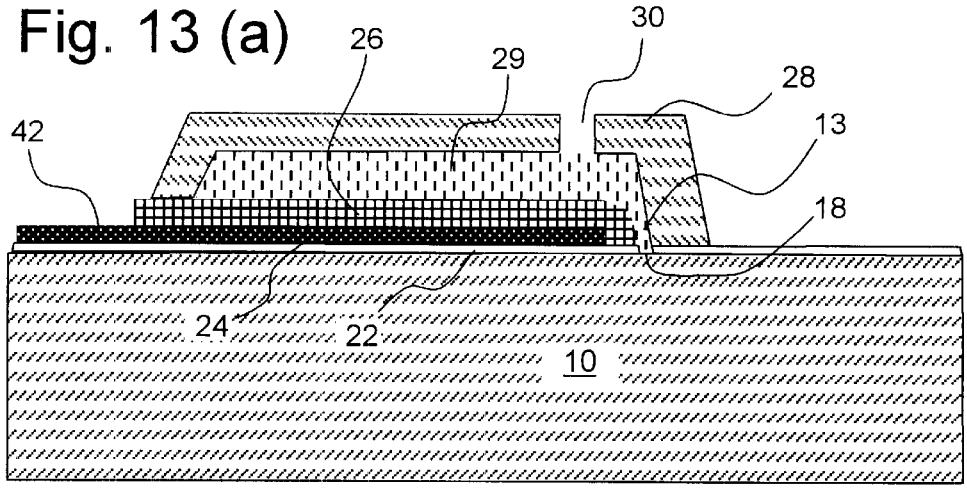
FIG. 13 is a side view of final stages of the manufacturing method according to the present inventions wherein a movement volume and liquid chamber is created by removing sacrificial material, and the thermal actuator is released and the fluid pathway completed by removing substrate material beneath the moveable and free edge areas.
Figure 13:
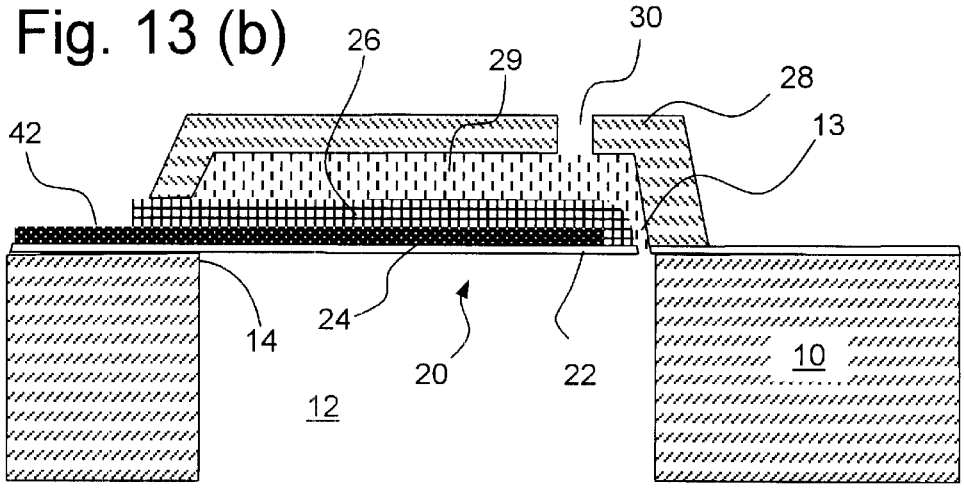
Figure 13:
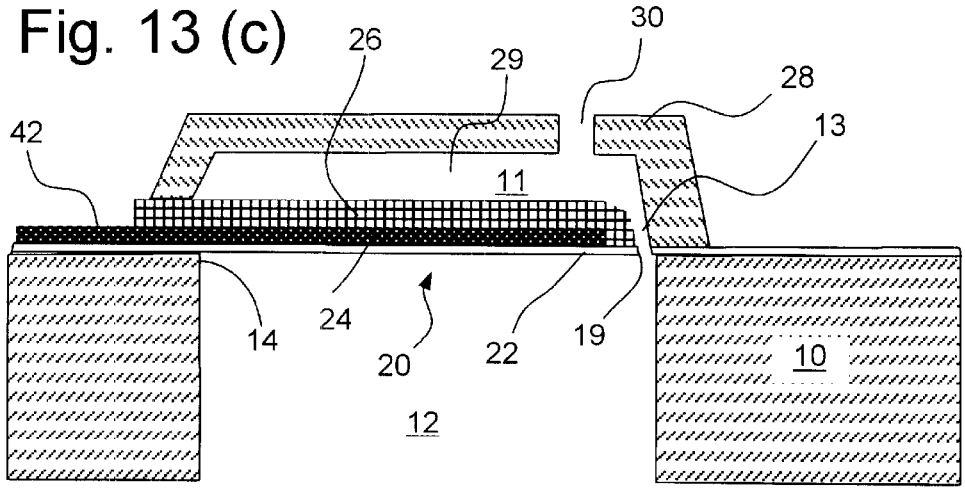

FIG. 13 shows a side view of the device through a section indicated as A—A in FIG. 12. In FIG. 13*a* the sacrificial layer 29 is enclosed within the drop emitter chamber walls 28 except for nozzle opening 30. Also illustrated in FIG. 10*a*, the substrate 10 is intact. The substrate is covered by sacrificial material in gap area 13 immediately above free edge area 18 adjacent the free edges of the cantilevered element. For the configuration illustrated in FIG. 13, the most outer edge of the moveable portion of the cantilevered element coincides with the free edges 19 of bottom layer 22 as illustrated in FIGS. 8–10.

In FIG. 13*b*, substrate 10 is removed beneath the cantilevered element 20, the liquid chamber areas around and beside the cantilevered element 20 and the free edge area 18. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release cantilevered element 20 from attachment to substrate 10.

Removal of the substrate material, in addition to releasing the moveable portion of the thermal actuator, opens a pathway for liquid to enter the liquid control device from the substrate. At the fabrication stage illustrated in FIG. 13*b*, liquid entering from lower liquid chamber volume 12 may touch the bottom layer 22 of the cantilevered element 20, the sacrificial material in gap area 13, and the sacrificial material in the large refill areas 33 (see FIGS. 8–10) flanking the cantilevered element, not visible in this A—A cross sectional view lengthwise through the cantilevered element. The refill areas are sized to provide rapid refill of upper liquid chamber 11 following drop ejection for liquid drop emitter devices.

In FIG. 13c the sacrificial material layer 29 has been removed using a penetrating process such as dry etching using oxygen and fluorine sources. The etchant gasses enter via the nozzle 30 and from the newly opened fluid supply chamber area 12, etched previously from the backside of substrate 10. This step removes the sacrificial material from the movement volume of the device, allowing the cantilevered element 20 to move freely and completes the fabrication of a liquid drop emitter structure.

The process steps of removing the substrate material and removing the sacrificial material illustrated in FIG. 13 may be performed in either order. It may be beneficial to remove the substrate material and then singulate individual devices leaving the sacrificial material intact to protect the movable portion of the thermal actuator and prevent particles from entering the movement volume. A drop emitter device may be mechanically mounted, and interconnected electrically and fluidically with a protective filter, in a less clean environment if the sacrificial material is left inside the device until a later, final step in the overall manufacturing workflow. However, it is also feasible to remove the sacrificial material first when the substrate is still whole. This process latter order offers the productivity advantage of performing the sacrificial material etch on a wafer level set of devices, instead of individually.

FIG. 14 illustrates a side view of the final stages of the methods of manufacturing of the present inventions applied to a buckling member style thermal actuator. The earlier steps of the manufacturing process would proceed in analogous fashion to those described for a cantilevered element thermal actuator and illustrated in FIGS. 8–12. The side views in FIG. 14 are formed along line B—B of FIG. 6*a*. They show a cut through a drop emitter nozzle along a line perpendicular to the long dimension of buckling member 40 also illustrated in FIGS. 5–7.

In FIG. 14*a* the sacrificial layer 29 is enclosed within the drop emitter chamber walls 28 except for nozzle opening 30. The substrate 10 is intact. The substrate is covered by sacrificial material in gap area 13 immediately above free edge area 18 adjacent the free edges of the cantilevered element. For the configuration illustrated in FIG. 14, the most outer edge of the moveable portion of the buckling member 40 coincides with the free edges 19 of bottom layer 22. Also illustrated in FIG. 14*a* are sacrificial material structure areas 16 which are encased in the structure material.

In FIG. 14*b* substrate 10 is removed beneath buckling member 40, the liquid chamber areas around and beside the buckling member 40 and the free edge area 18. The removal may be done by an anisotropic etching process such as reactive ion etching, or such as orientation dependent etching for the case where the substrate used is single crystal silicon. Also in FIG. 14*b* the sacrificial material layer 29 has been removed using a penetrating process such as dry etching using oxygen and fluorine sources. The etchant gasses enter via the nozzle 30 and from the newly opened fluid supply chamber area 12, etched previously from the backside of substrate 10. This step removes the sacrificial material from the movement volume of the device, allowing the buckling member 40 to move freely and completes the fabrication of a liquid drop emitter structure.

The sacrificial material in the structure areas 16 flanking the movement volume or liquid chamber 11 is left encapsulated by the structure material. These areas of sacrificial material serve to strengthen the device against damage from the pressure impulses employed to emit drops and against damage from front face maintenance hardware such as blotters or wipers. The structure illustrated in FIG. 14 is generally more planar in the vicinity of the nozzles than is the buckling member activated device illustrated in FIG. 7.

There are typically large areas in an array of ink jet devices which are not filled with liquid but are needed to provide enough spacing for lead attachments, fluid entry passages and the like. Except in the vicinity of electrical lead attachment locations, large spacing areas may be filled with sacrificial material, encapsulated with structure material, and left in place in the final device. The resulting device is mechanically more robust and more effectively cleaned on the nozzle face. Structure material alone cannot be expected to fill the deep topography of the device and still have the proper thickness for nozzle bores in the top cover portions of liquid chamber areas.

FIG. 15 illustrates three alternative configurations for the top 26, deflector 24 and bottom 22 layers at the free edges of the moveable portion of a thermal actuator, adjacent the free edge area 18 of exposed substrate 10. FIG. 15 is drawn for a buckling member configuration at the manufacturing step wherein the structure layer 28 has been formed but neither substrate material nor sacrificial material have been removed. In FIG. 15*a*, top layer 26 overlaps deflector layer 24 but does not overlap bottom layer 22. Also, for this example illustration, the top layer has been deposited as a thinner layer than the bottom layer. When released and operated, the buckling member actuator will deform upward toward nozzle 30.

In FIG. 15*b*, top layer 26 overlaps deflector layer 24 and coincides in width with bottom layer 22. This configuration may be fabricated by patterning the top and bottom layers at the same time in the area of the buckling member, after the deflector layer is patterned above an unpatterned bottom layer.

In FIG. 15*c*, top layer 26 overlaps deflector layer 24 and bottom layer 22. This configuration may be fabricated by patterning the deflector and bottom layers at the same time in the area of the buckling member, and then forming and patterning the top layer. For this layer edge configuration the thermal actuator free edges coincide with the free edges of the top layer. Also, in the design shown in FIG. 15*c*, the top material has been deposited in a thicker layer than the bottom material. This configuration of a buckling member will deform downward, away from outlet port 32 when released and operated. A downward moving actuator is useful in construction a normally closed microvalve, as described hereinbelow.

While most of the preceding discussion has used liquid drop emitters, especially ink jet printheads as illustrative examples, many other liquid control devices may be fabricated by the methods of manufacturing of the present inventions. FIGS. 16 and 17 illustrate normally open and normally closed fluid microvalves which are manufacturable according to the present inventions.

Figure 16A:
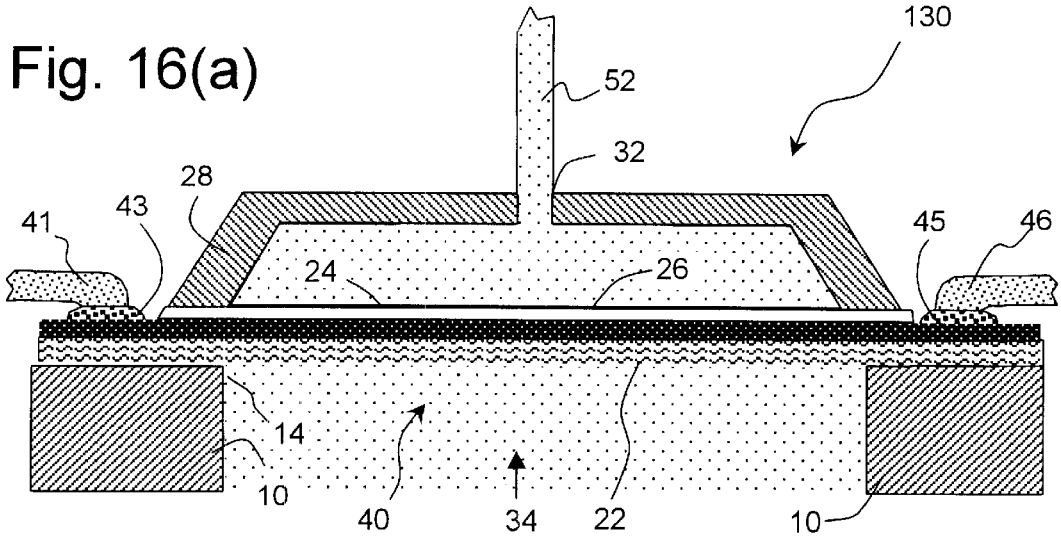
FIG. 16 is a side view illustrating the configuration of a normally open microvalve according to preferred embodiments of the present invention.
Figure 16B:
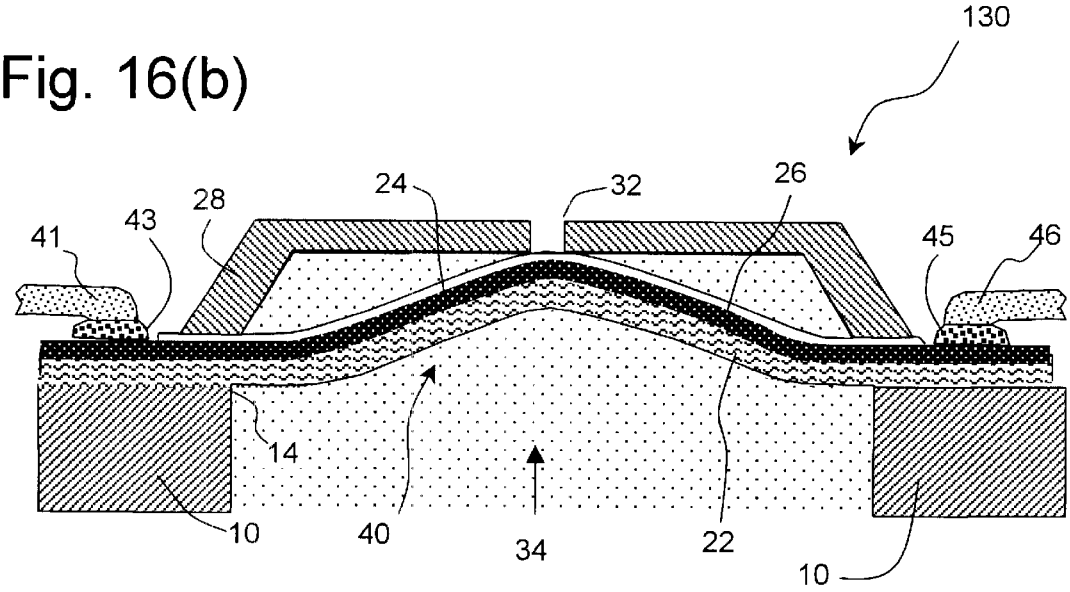
Figure 17:
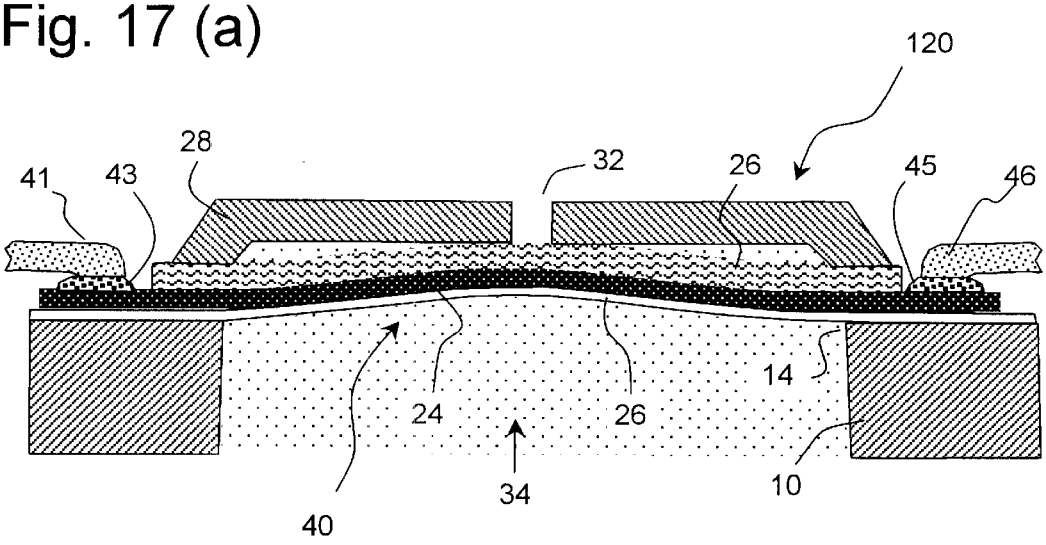
FIG. 17 is a side view illustrating the configuration of a normally closed microvalve according to preferred embodiments of the present invention.
Figure 17:
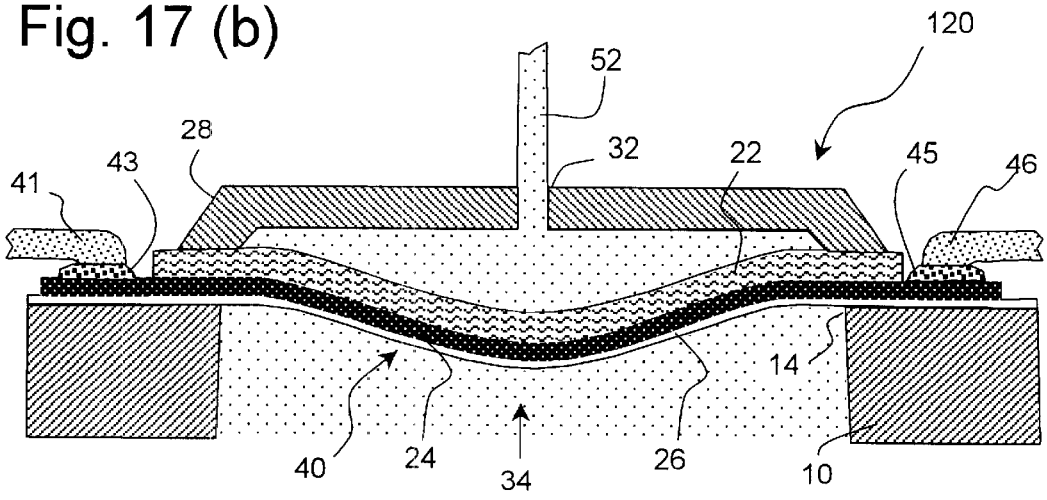

A normally open microvalve 130 may be configured as shown in FIG. 16. A buckling member 40 is positioned in proximity to a fluid flow port 32, sufficiently close so that the buckling deformation is sufficient to close flow port 32. This configuration allows fluid to flow freely from a pressure source via an inlet path 34 and then out the fluid flow outlet port 32 forming stream 52 (FIG. 16*a*). When a heat pulse is applied to the heater resister formed in the deflector material, deflector layer 24 elongates relative to thick bottom layer 22 urging the deformable element against fluid flow port 32, closing the valve (FIG. 16*b*). The normally open microvalve 130 may be maintained in a closed state by continuing to heat the deformable element sufficiently to maintain the upward buckled state.

A normally closed microvalve 120 may be configured as shown in FIG. 17. Buckling member 40 is formed with sufficient residual stress that it urges itself against a fluid flow port 32 when buckling member 40 assumes a residual bowed shape after the removal of the sacrificial material and release from the substrate (FIG. 17*a*). A residual bowed shape may be obtained, for example, by controlling the deposition parameters of the deflector material, as was discussed above for RF or DC magnetron sputtering of titanium aluminide. In the configuration illustrated, fluid is admitted from a source under pressure via an inlet path 34 (FIG. 17*a*). When an electrical pulse is applied to the heater resistor formed in the deflector material, deflector layer 24 elongates relative to thick top layer 26 causing a downward deformation of the buckling member, opening outlet port 32 and releasing fluid stream 52. The normally closed microvalve 120 may be maintained in an open state by continuing to heat the buckling member sufficiently to maintain the downward buckled state.

While much of the foregoing description was directed to the fabrication of a single drop emitter or microvalve, it should be understood that the present invention is applicable to forming arrays and assemblies of multiple drop emitter units and valve units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

| | |
|---|---|
| 10 | substrate base element |
| 11 | movement volume or upper liquid chamber |
| 12 | lower liquid chamber |
| 13 | gap between thermal actuator and chamber wall |
| 14 | wall edge at cantilevered element or buckling member anchor points |
| 15 | thermal actuator |
| 16 | sacrificial material retained in the finished structure for strength |
| 17 | anchored portion of the cantilevered element |

-continued

| | |
|---|---|
| | or buckling member |
| 18 | free edge area on the substrate |
| 19 | bottom layer free edges |
| 20 | cantilevered element |
| 21 | moveable portion of the cantilevered element or buckling member |
| 22 | bottom layer |
| 24 | deflector layer |
| 26 | top layer |
| 27 | resistor portion of deflector layer |
| 28 | liquid chamber structure, walls and top cover |
| 29 | sacrificial layer |
| 30 | nozzle |
| 31 | upper surface of the movement volume formed in the sacrificial layer |
| 32 | outlet port of a microvalve |
| 33 | refill areas removed from the substrate |
| 34 | fluid supply entrance pathway |
| 40 | buckling member |
| 41 | TAB lead |
| 42 | electrical input pad |
| 43 | solder bump |
| 44 | electrical input pad |
| 50 | drop |
| 52 | fluid output stream from a microvalve |
| 60 | fluid |
| 80 | mounting structure |
| 100 | ink jet printhead |
| 110 | drop emitter unit |
| 120 | normally closed microvalve |
| 130 | normally open microvalve |
| 200 | electrical pulse source |
| 300 | controller |
| 400 | image data source |
| 500 | receiver |

What is claimed is:

1. A method for manufacturing a thermal actuator for a micro-electromechanical device comprising the steps of:

forming a bottom layer of a bottom material on a substrate composed of a substrate material;

removing the bottom material in a bottom layer pattern wherein a moveable area located between opposing free edges remains on the substrate;

forming a deflector layer of a deflector material over the bottom layer;

removing the deflector material in a deflector layer pattern wherein the deflector material does not overlap the free edges of the bottom layer material; and removing the substrate material beneath the moveable area so that the free edges of the bottom layer are released from the substrate.

2. A method for manufacturing a thermal actuator for a micro-electromechanical device according to claim 1 wherein the substrate material is silicon.

3. A method for manufacturing a thermal actuator for a micro-electromechanical device according to claim 1 wherein the step of forming the bottom layer comprises the oxidation of the substrate material.

4. A method for manufacturing a thermal actuator for a micro-electromechanical device according to claim 1 wherein the step of forming the bottom layer comprises a high temperature deposition process.

5. A method for manufacturing a thermal actuator for a micro-electromechanical device according to claim 1 wherein the step of forming the deflector layer comprises a high temperature deposition process.

6. A method for manufacturing a thermal actuator for a micro-electromechanical device according to claim 1 wherein the deflector material has a large coefficient of thermal expansion.

7. A method for manufacturing a thermal actuator for a micro-electromechanical device according to claim 1 wherein the deflector material is electrically resistive.

8. A method for manufacturing a thermal actuator for a micro-electromechanical device according to claim 1 wherein the deflector material is titanium aluminide.

9. A method for manufacturing a thermal actuator for a micro-electromechanical device according to claim 1 wherein the deflector layer pattern and the bottom layer pattern are the same and the steps of removing the bottom material and the deflector material are done at the same time.

10. A method for manufacturing a thermal actuator for a micro-electromechanical device according to claim 1 wherein the step of removing the substrate material is an etching process that is highly selective in etching the substrate material relative to the bottom material.

11. A method for manufacturing a thermal actuator for a micro-electromechanical device according to claim 1 wherein the thermal actuator is used in contact with a working fluid and the bottom material is chemically inert to the working fluid.

12. A method for manufacturing a thermal actuator for a micro-electromechanical device according to claim 1 wherein the bottom layer pattern includes a free edge area where the substrate material is exposed and further comprises the steps of:

forming a top layer of a top material over the deflector layer, the bottom layer, and the substrate;

removing the top material in a top layer pattern wherein the top material overlaps the deflector layer material but does not completely overlap the substrate material in the free edge area.

13. A method for manufacturing a thermal actuator for a micro-electromechanical device according to claim 12 wherein the top material is a dielectric material.

14. A method for manufacturing a thermal actuator for a micro-electromechanical device according to claim 12 wherein the step of forming the top layer comprises a high temperature deposition process.

15. A method for manufacturing a thermal actuator for a micro-electromechanical device according to claim 12 wherein the top material overlaps the deflector material but does not overlap the bottom material.

16. A method for manufacturing a thermal actuator for a micro-electromechanical device according to claim 12 wherein the top layer pattern and the bottom layer pattern are the same and the steps of removing the bottom layer material and the top material are done at the same time.

17. A method for manufacturing a thermal actuator for a micro-electromechanical device according to claim 12 wherein the step of removing the substrate material is an etching process that is highly selective in etching the substrate material relative to the bottom material and the top material.

18. A method for manufacturing a thermal actuator for a micro-electromechanical device according to claim 12 wherein the thermal actuator is used in contact with a working fluid and the top material is chemically inert to the working fluid.

19. A method for manufacturing a movement volume for a thermal actuator comprising the steps of:

forming on a substrate having a flat surface and composed of a substrate material, a thermal actuator having a moveable area located between opposing actuator free edges wherein the substrate material remains exposed in a free edge area adjacent the actuator free edges;

conforming a sacrificial layer of a sacrificial material over the thermal actuator and substrate in sufficient thickness to result in a planar sacrificial layer surface parallel to the flat surface, removing the sacrificial material in a sacrificial layer pattern in wherein sacrificial material remains in movement areas and free edge areas;

conforming a structure layer of a structure material over the sacrificial layer, removing the structure material in a structure layer pattern wherein sacrificial material is exposed in movement areas, and removing exposed sacrificial material from the movement areas and free edge areas thereby creating a movement volume for the thermal actuator.

20. A method for manufacturing a movement volume for a thermal actuator according to claim 19 wherein the sacrificial material is non-photoimageable polyimide.

21. A method for manufacturing a movement volume for a thermal actuator according to claim 19 wherein the sacrificial layer pattern further comprises structure areas where sacrificial material remains and the structure layer pattern does not expose the sacrificial material in structure areas, thereby leaving sacrificial material in structure areas beneath structure material.

22. A method for manufacturing a movement volume for a thermal actuator according to claim 19 further comprising the step of:

removing the substrate material beneath the moveable area and free edge area so that the actuator free edges are released from the substrate and the movement volume is extended into the substrate.

23. A method for manufacturing a liquid control device having a thermal actuator which moves against a working liquid contained in a liquid chamber having an inlet and an outlet comprising the steps of:

forming on a substrate having a flat surface and composed of a substrate material, a thermal actuator having a moveable area located between opposing actuator free edges wherein the substrate material remains exposed in a free edge area adjacent the actuator free edges, conforming a sacrificial layer of a sacrificial material over the thermal actuator and substrate in sufficient thickness to result in a planar sacrificial layer surface parallel to the flat surface, removing the sacrificial material in a sacrificial layer pattern wherein sacrificial material remains in a liquid chamber area which includes the moveable area of the thermal actuator and the free edge area, conforming a structure layer of a structure material over the sacrificial layer;

removing the structure material in a structure layer pattern wherein sacrificial material is exposed via at least one structure opening in liquid chamber areas, removing exposed sacrificial material from the liquid chamber area;

removing the substrate material beneath the moveable area and free edge area so that the free edges of the thermal actuator are released from the substrate allowing the thermal actuator to move in the liquid chamber and liquid to enter the liquid chamber through the substrate and around the thermal actuator.

24. A method for manufacturing a liquid control device according to claim 23 wherein the liquid control device is a liquid drop emitter and movement of the thermal actuator pressurizes the working liquid to cause drops to be emitted from a structure opening.

25. A method for manufacturing a liquid drop emitter according to claim 24 wherein the liquid is an ink and the drops are emitted for the ink jet printing of image data.

26. A method for manufacturing a liquid control device according to claim 23 wherein the step of forming the thermal actuator comprises:

forming a bottom layer of a bottom material the substrate;

removing the bottom material in a bottom layer pattern wherein a moveable area located between opposing free edges remains on the substrate and substrate material is exposed in a free edge area adjacent the free edges;

forming a deflector layer of a deflector material over the bottom layer;

removing the deflector material in a deflector layer pattern wherein the deflector material does not overlap the free edges of the bottom material;

forming a top layer of a top material over the deflector layer, the bottom layer, and the substrate; and removing the top material in a top layer pattern wherein the top material overlaps the deflector layer material but does not completely overlap the substrate material in the free edge area.

27. A method for manufacturing a liquid control device according to claim 26 wherein the liquid control device is a liquid drop emitter and movement of the thermal actuator pressurizes the working liquid to cause drops to be emitted from a structure opening.

28. A method for manufacturing a liquid drop emitter according to claim 27 wherein the liquid is an ink and the drops are emitted for the ink jet printing of image data.

29. A method for manufacturing a liquid drop emitter according to claim 27 wherein the substrate material is silicon.

30. A method for manufacturing a liquid drop emitter according to claim 27 wherein the step of forming the bottom layer comprises the oxidation of the substrate material.

31. A method for manufacturing a thermal actuator for a micro-electromechanical device according to claim 27 wherein the deflector material has a large coefficient of thermal expansion.

32. A method for manufacturing a liquid drop emitter according to claim 27 wherein the deflector material is electrically resistive.

33. A method for manufacturing a thermal actuator for a micro-electromechanical device according to claim 27 wherein the deflector material is titanium aluminide.

34. A method for manufacturing a liquid drop emitter according to claim 27 wherein the bottom material and the top material are chemically inert to the working fluid.

35. A method for manufacturing a liquid drop emitter according to claim 27 wherein the top material is a dielectric material.

36. A method for manufacturing a liquid drop emitter according to claim 27 wherein the step of removing the substrate material is an etching process that is highly selective in etching the substrate material relative to the bottom material and the top material.

37. A method for manufacturing a liquid drop emitter according to claim 27 wherein the sacrificial material is non-photoimageable polyimide.

38. A method for manufacturing a liquid control device according to claim 26 wherein the sacrificial layer pattern further comprises structure areas where sacrificial material remains and the structure layer pattern does not expose the sacrificial material in structure areas, thereby leaving sacrificial material in structure areas beneath structure material.

39. A method for manufacturing a liquid control device according to claim 26 wherein the liquid control device is a normally open valve wherein fluid enters the liquid chamber via a structure opening and movement of the thermal actuator closes the structure opening.

40. A normally open valve made by the method of manufacturing according to claim 39.

41. A method for manufacturing a liquid control device according to claim 26 wherein the liquid control device is a normally closed valve wherein fluid exits the liquid chamber via a structure opening and movement of the thermal actuator opens the structure opening.

42. A normally closed valve made by the method of manufacture according to claim 41.

* * * * *